US009109797B2

(12) United States Patent
Chen

(10) Patent No.: US 9,109,797 B2
(45) Date of Patent: Aug. 18, 2015

(54) METALLIC WICK ASSEMBLY

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

(21) Appl. No.: 14/279,391

(22) Filed: May 16, 2014

(65) Prior Publication Data

US 2014/0248572 A1 Sep. 4, 2014

Related U.S. Application Data

(62) Division of application No. 13/740,316, filed on Jan. 14, 2013, now abandoned.

(30) Foreign Application Priority Data

Sep. 26, 2012 (TW) ..... 101135342 A

(51) Int. Cl.
*F23D 3/18* (2006.01)
*F21V 37/00* (2006.01)

(52) U.S. Cl.
CPC ..... *F23D 3/18* (2013.01); *F21V 37/002* (2013.01); *F23D 2900/03082* (2013.01)

(58) Field of Classification Search
CPC ..... F23D 3/18; F23D 3/24; F23D 14/14; F23D 14/145; F23D 2212/201; F23D 2900/03082; F21V 37/002
See application file for complete search history.

(56) References Cited

U.S. PATENT DOCUMENTS

| | | | | |
|---|---|---|---|---|
| 4,269,591 | A * | 5/1981 | Knoll | 431/312 |
| 5,305,941 | A | 4/1994 | Kent et al. | |
| 6,270,340 | B1 * | 8/2001 | Lepp | 431/288 |

FOREIGN PATENT DOCUMENTS

| | | | |
|---|---|---|---|
| TW | 493722 | U | 7/2002 |
| TW | 580106 | U | 3/2004 |

* cited by examiner

*Primary Examiner* — Alfred Basichas
(74) *Attorney, Agent, or Firm* — Alan D. Kamrath; Kamrath IP Lawfirm, P.A.

(57) ABSTRACT

A metallic wick assembly includes at least one mesh member and a sleeve member. The at least one mesh member includes a first length defined between first and second ends thereof. The sleeve member is mounted around the mesh member and includes a second length defined between two longitudinal opposite ends thereof. The second length is less than the first length. A third length is defined between a distal end of the sleeve member and the first end of the mesh member. The sleeve member is slidable with respect to the mesh member to adjust the third length for controlling the flame scale.

20 Claims, 24 Drawing Sheets

METALLIC WICK ASSEMBLY

CROSS REFERENCE

The present application is a division of prior U.S. patent application Ser. No. 13/740,316, filed on Jan. 14, 2013, entitled "METALLIC WICK ASSEMBLY", now abandoned, which claims priority of Taiwan patent application Ser. No. 101135342, filed on Sep. 26, 2012, the entirety of which is incorporated herein by reference.

BACKGROUND OF THE INVENTION

1. Field of the Invention

The present invention relates to a wick assembly and, more particularly, to a wick assembly made of metal and provided for being mounted to a lamp device for precisely controlling the flame combustion scale.

2. Description of the Related Art

A conventional lamp device includes a fuel cup storing fuel, and a wick connecting into fuel stored in the fuel cup. Moreover, the wick is normally made out of braided cotton and works by capillary action. Fuel is drawn up through the wick to reach the flame produced on the disk. The above lamp device is actively used for various purposes, such as lighting, decorating, or increasing atmosphere. For example, an oil lamp is used in religion, or an alcohol lamp is used in medical or chemical laboratories.

The conventional cotton wick must be cut to a predetermined length adapted for being mounted to the lamp device. However, after trimming, the cotton wick is easily loosened at its terminal end. After ignition, fuel vaporizes and combusts on the wick, and the tip of the cotton wick will be carbonized and burnt out gradually on the tip due to the higher temperature on the top of flame. Thus, the cotton wick must be pulled out and trimmed to a certain length every once in a while to maintain combustion scale. Trimming the cotton wick results in the wick eventually being unconnected with fuel, so that users can only replenish fuel or replace a new wick. It is inconvenient and wasteful.

The wick length, diameter, stiffness and fire-resistance are major factors used to adjust fuel wicking and flame scale for the lamp device. However, cotton wicks with low stiffness and low fire-resistance cannot be adjusted easily to maintain proper fuel wicking and flame scale, especially for high viscosity or high flash point fuels, resulting in producing carbon deposits and difficulty to ignite. If the fuel drawn is slower than it burns, the wick will be carbonized and burnt out. If the fuel drawn is more than it burns, usually occurring on burning high flash point fuel, it will cause slow evaporation of the fuel and will produce soot due to incomplete combustion. Incomplete combustion not only produces soot but also toxic fumes.

Taiwan Patent No. 493,722 discloses a wick including a plurality of fiberglass filaments disposed and assembled at a center thereof to form a fiberglass layer, and a plurality of fiberglass yarns and melted silks arranged around the fiberglass layer. The fiberglass layer is able to draw fuel by capillary action, is hard to burn down, and is not easily loosened at its terminal end. However, the fiberglass layer does not draw fuel effectively to cause the flame to be extinguished easily and cause the flame scale difficult to be controlled. Moreover, Taiwan Patent No. 580,106 discloses a wick including a cotton thread to draw fuel and a plurality of fiberglass filaments covering around the cotton thread to avoid the cotton thread diverging, to provide a compound wick.

Therefore, the wick disclosed by said patents both include fiberglass filaments, but fiberglass is expensive with difficult processing. Momentously, the wick is a large quantity of consumable items, but the fiberglass wick is expensive and not environment-friendly. Additionally, when the fiberglass wick is processed, inhaling the fiberglass can cause damage to human lungs and be harmful to manufacturing personnel Inhaling of fiberglass will jeopardize the health of workers during fiberglass-reinforced plastic processing. The fiberglass fiber can also cause skin, eye and throat irritation to users. At higher exposure levels, fiberglass also has been associated with skin rashes and difficulty in breathing.

Likewise, the fiberglass wick will be carbonized and burned out during combustion, but only slower than a cotton wick, so that the fiberglass wick needs to be trimmed also. Furthermore, the fiberglass wick and the cotton wick sag easily due to gravity when they are saturated with fuel. Thus, the user cannot adjust the flame height or scale easily. If a user wants to adjust the flame height or scale, the user has to pull the wick out from the lamp device constantly. At the same time, the user may also contact fuel in the wick and cause inconvenience or even danger.

The present invention is, therefore, intended to obviate or at least alleviate the problems encountered in the prior art.

SUMMARY OF THE INVENTION

The present invention overcomes these requirements and other problems in the field of a metallic wick assembly including at least one mesh member and a sleeve member mounted around the mesh member. The mesh member includes first and second ends disposed opposite to each other, first and second surfaces respectively extended from the first end to the second end thereof and arranged opposite to each other, a plurality of meshes penetrating the first and second surfaces between the first and second ends thereof, and a transport channel extending from the first end to the second end thereof drawing fuel by capillary action. The mesh member includes a first length defined between the first and second ends thereof. The sleeve member includes a second length defined between two longitudinal opposite ends thereof. The second length of the sleeve member is less than the first length. A third length is defined between a distal end of the sleeve member and the first end of the mesh member. The sleeve member is slidable with respect to the mesh member to adjust the third length for controlling the flame scale.

In an example, the metallic wick assembly generally includes a mesh member rolled into a tubular shape and having a plurality of circles spaced from each other along a longitudinal axis to form an Archimedean spiral cross-section perpendicular to the longitudinal axis.

In another example, the metallic wick assembly generally includes the sleeve member having a plurality of apertures, with the sleeve member delimiting first and second sections at two opposite ends thereof, with the plurality of apertures arranged at the first section to provide fuel passing therethrough and drawn up freely to the first end of the mesh member.

Preferably, the first section of the sleeve member is arranged adjacent to the first end of the mesh member and has a fifth length. The second section of the sleeve member is arranged adjacent to the second end of the mesh member and has a sixth length. The fifth length is less than the sixth length.

Preferably, the range of the ratio of the fifth length to the sixth length is 0.3 to 0.5.

In another example, the metallic wick assembly includes a plurality of mesh members respectively rolled into the plurality of different-sized tubes assembled and radially spaced from each other along a longitudinal axis to form a concentric circular cross section perpendicular to the longitudinal axis.

In a further example, the metallic wick assembly includes a plurality of mesh members spaced from each other and arranged in a longitudinal stacked array.

Preferably, each of the plurality of mesh members is formed in a flat shape.

Preferably, the sleeve member is made of metal and formed in a rectangular tubular shape.

An advantage of the metallic wick assembly according to the present invention is that the sleeve member is slidable with respect to the mesh member to adjust the third length for controlling the flame scale.

Another advantage of the metallic wick assembly according to the present invention is that the sleeve member is slidably mounted around the mesh member to prevent the mesh member from becoming unassembled.

A further advantage of the metallic wick assembly according to the present invention is that the sleeve member has the plurality of apertures to allow fuel to pass therethrough and to be drawn up freely to the first end of the mesh member.

A further advantage of the metallic wick assembly according to the present invention is that the sleeve member is slidably mounted around the mesh member, so that they are assembled with each other easily and quickly.

A further advantage of the metallic wick assembly according to the present invention is that the metallic wick assembly is made of metal, so that it cannot be carbonized or consumed to maintain a fixed shape and height to maintain the flame combustion scale.

A further advantage of the metallic wick assembly according to the present invention is that the mesh member has an end producing the flame thereon and heated by the flame to cause fuel drawn to the end thereof to be vaporized and combusted more completely due to higher wick temperature.

A further advantage of the metallic wick assembly according to the present invention is that the number of circles, the size of meshes, the surface roughness and the coating materials of the mesh member are adjustable to control the ability of capillary action adapted for wicking various fuels with different viscosity, so that the metallic wick assembly can draw more viscous fuel faster to the tip thereof and can be ignited in a short time (one minute or less) after inserting the wick in fuel.

A further advantage of the metallic wick assembly according to the present invention is that the metallic wick assembly does not loosen at a terminal end of the mesh member after cutting a predetermined length or trimming, allowing the metallic wick assembly to be mounted on the lamp device easily.

A further advantage of the metallic wick assembly according to the present invention is that the metallic wick assembly is made of metal, reducing manufacturing costs to provide a popular price. In a preferred form, the mesh member can be formed by a common metal wire mesh, and the sleeve member can be formed by a common metal tube.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
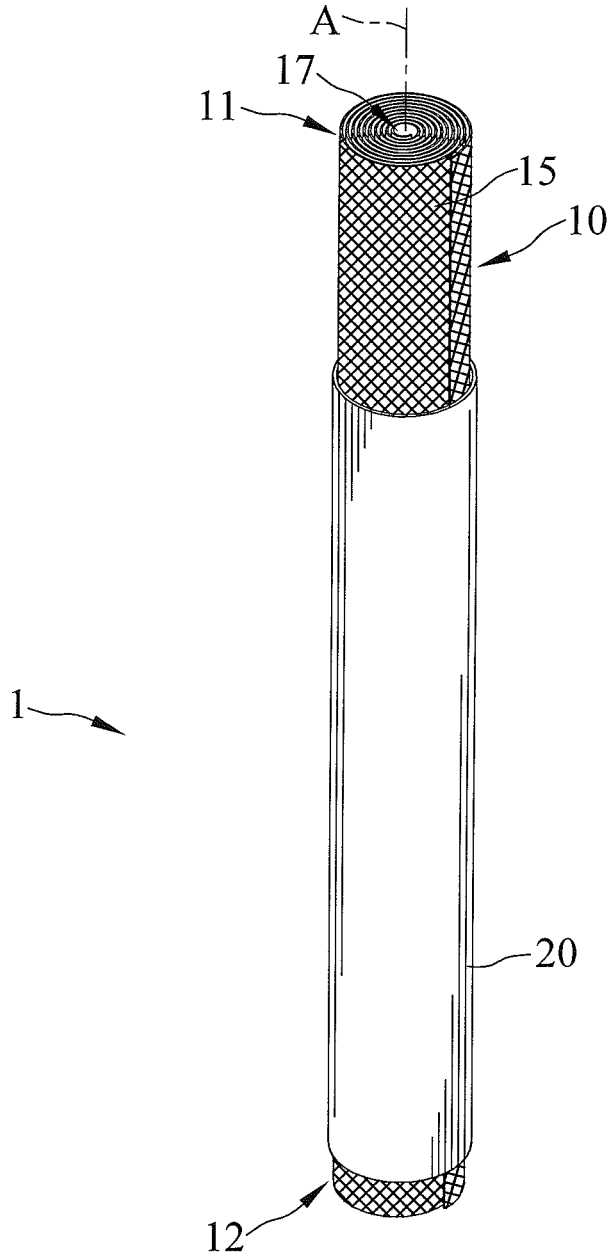
FIG. 1 shows a perspective view of a metallic wick assembly of a first embodiment according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE PREFERRED EMBODIMENTS

Figure 2:
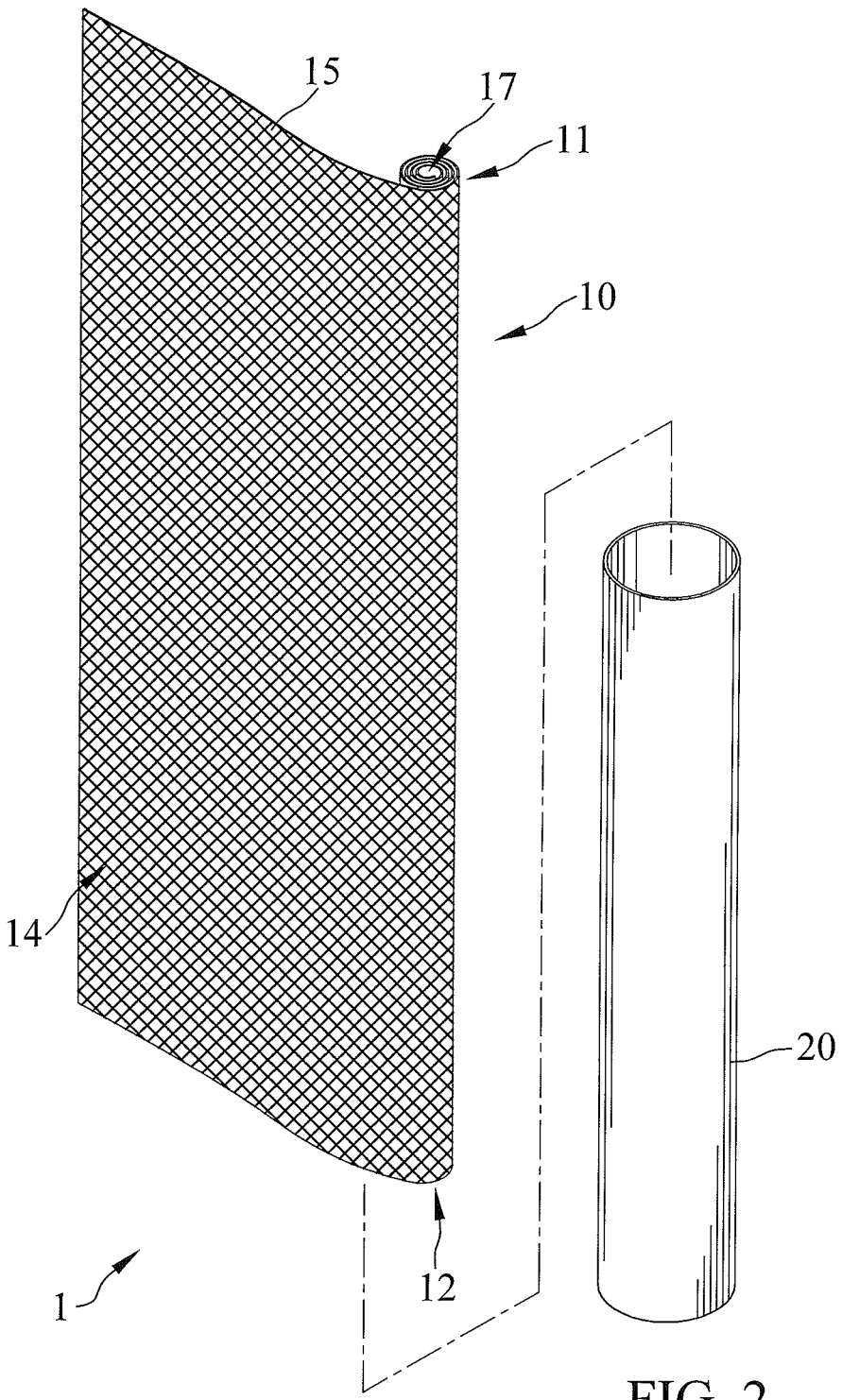
FIG. 2 shows an exploded, perspective view of the metallic wick assembly of FIG. 1.
Figure 3:
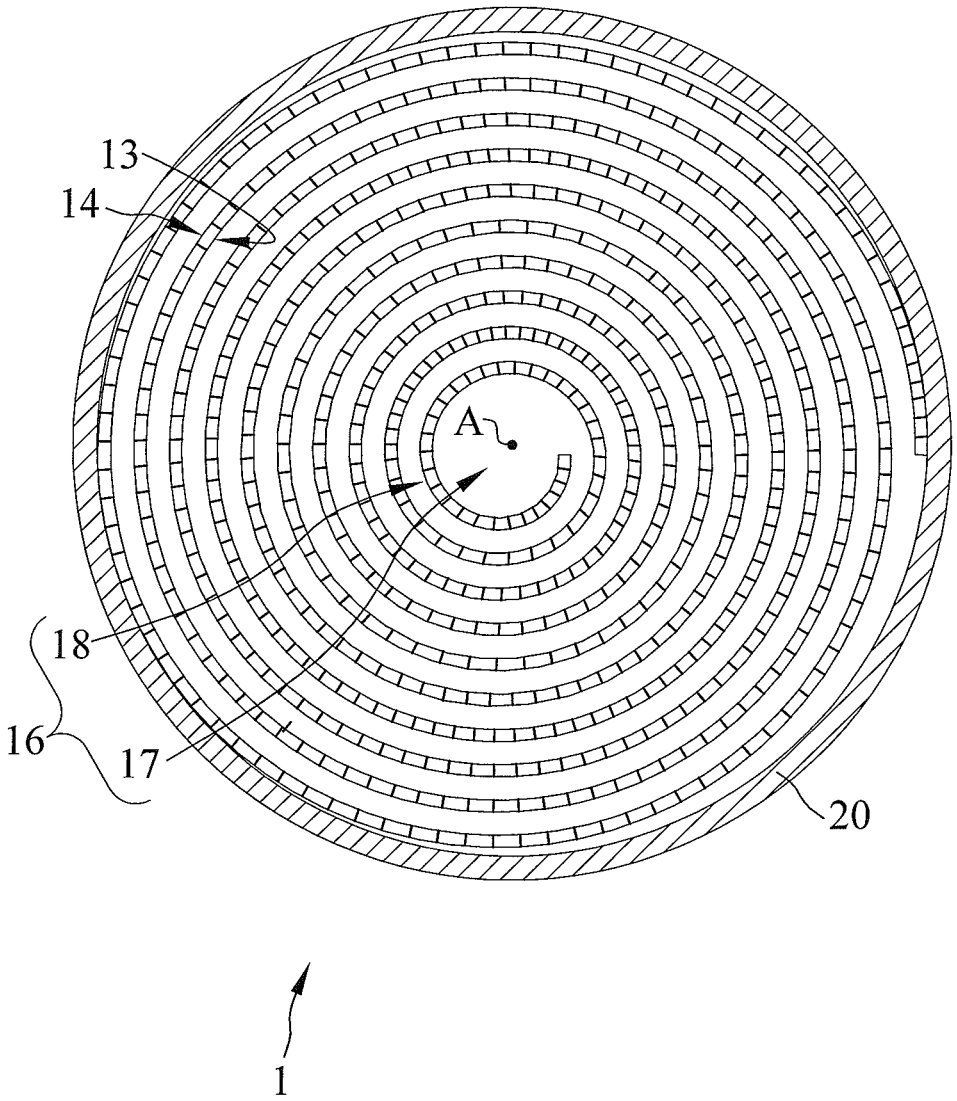
FIG. 3 shows a cross-section view of the metallic wick assembly of FIG. 1.
Figure 4:
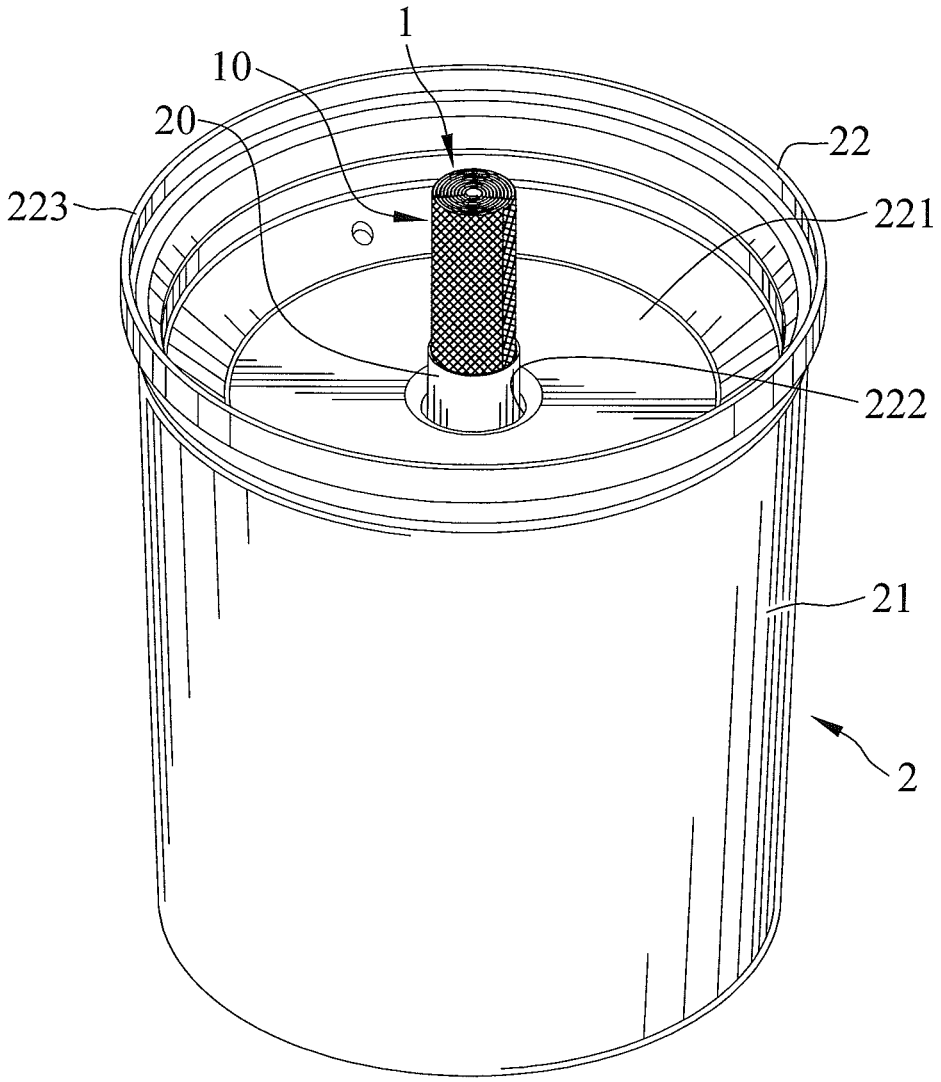
FIG. 4 shows a perspective view of the metallic wick assembly of FIG. 1, and illustrates the metallic wick assembly mounted to a lamp device.
Figure 5:
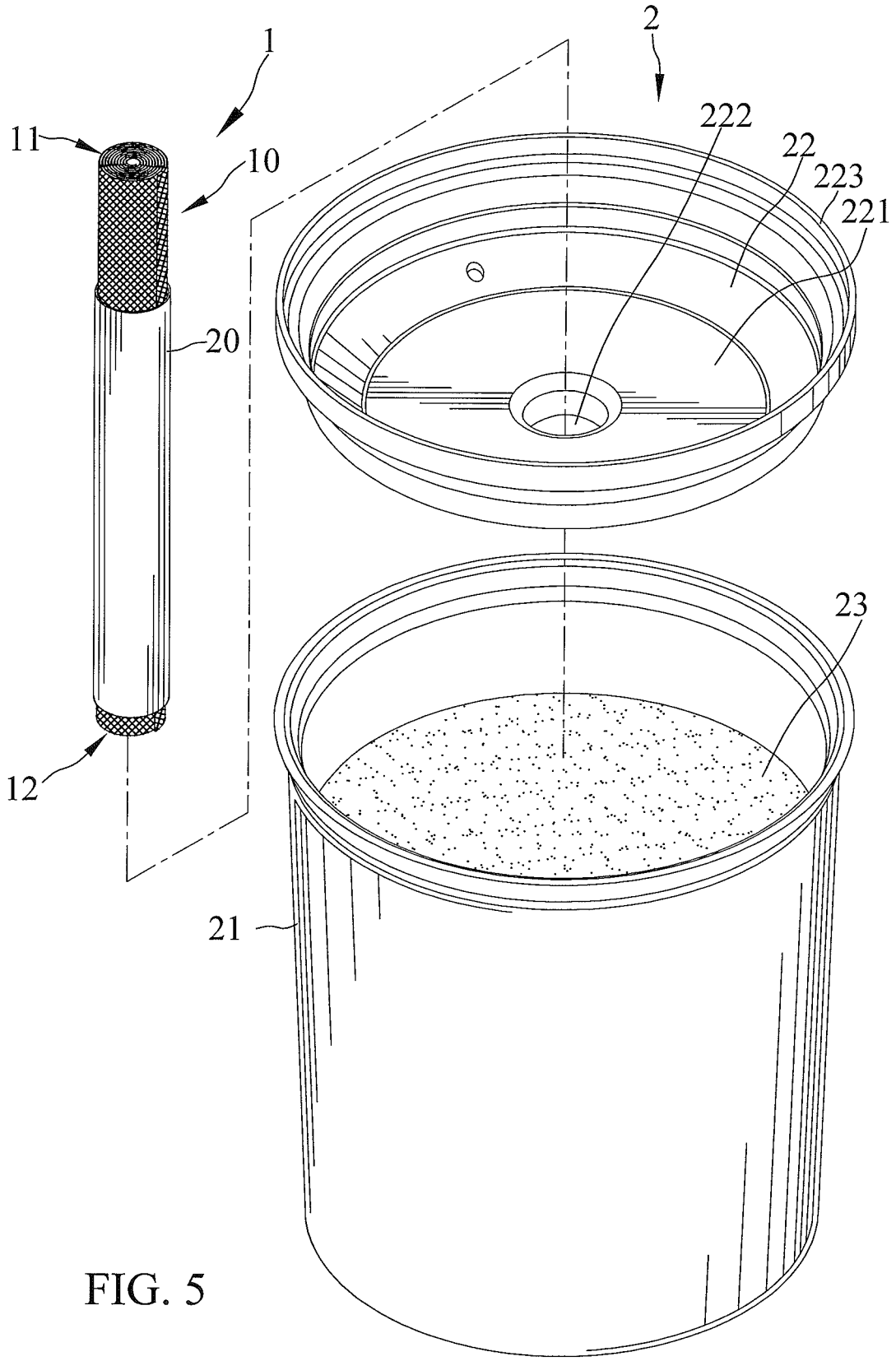
FIG. 5 shows an exploded, perspective view of FIG. 4.
Figure 6:
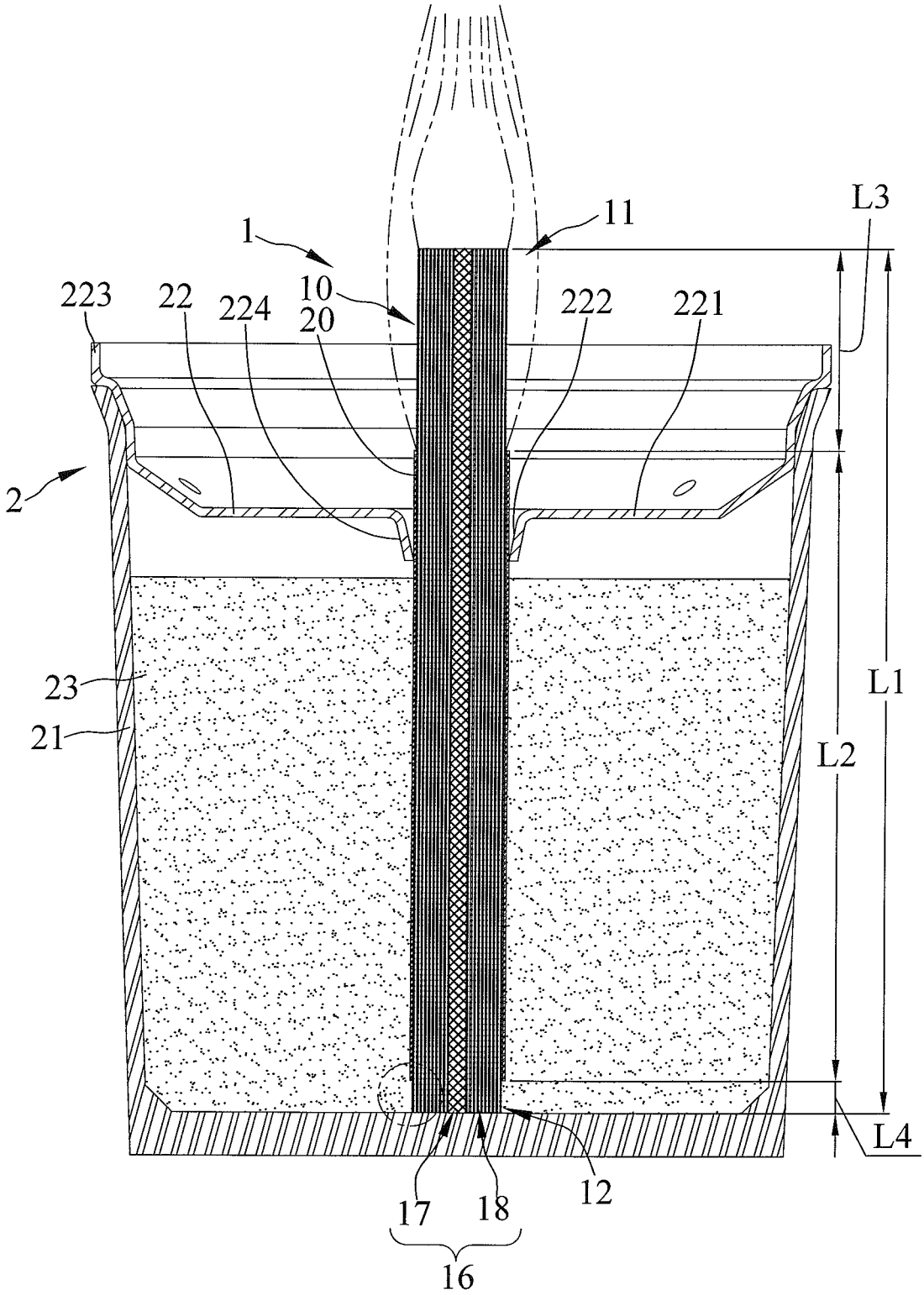
FIG. 6 shows a cross-section view of FIG. 4, and illustrates the flame scale being larger.
Figure 7:
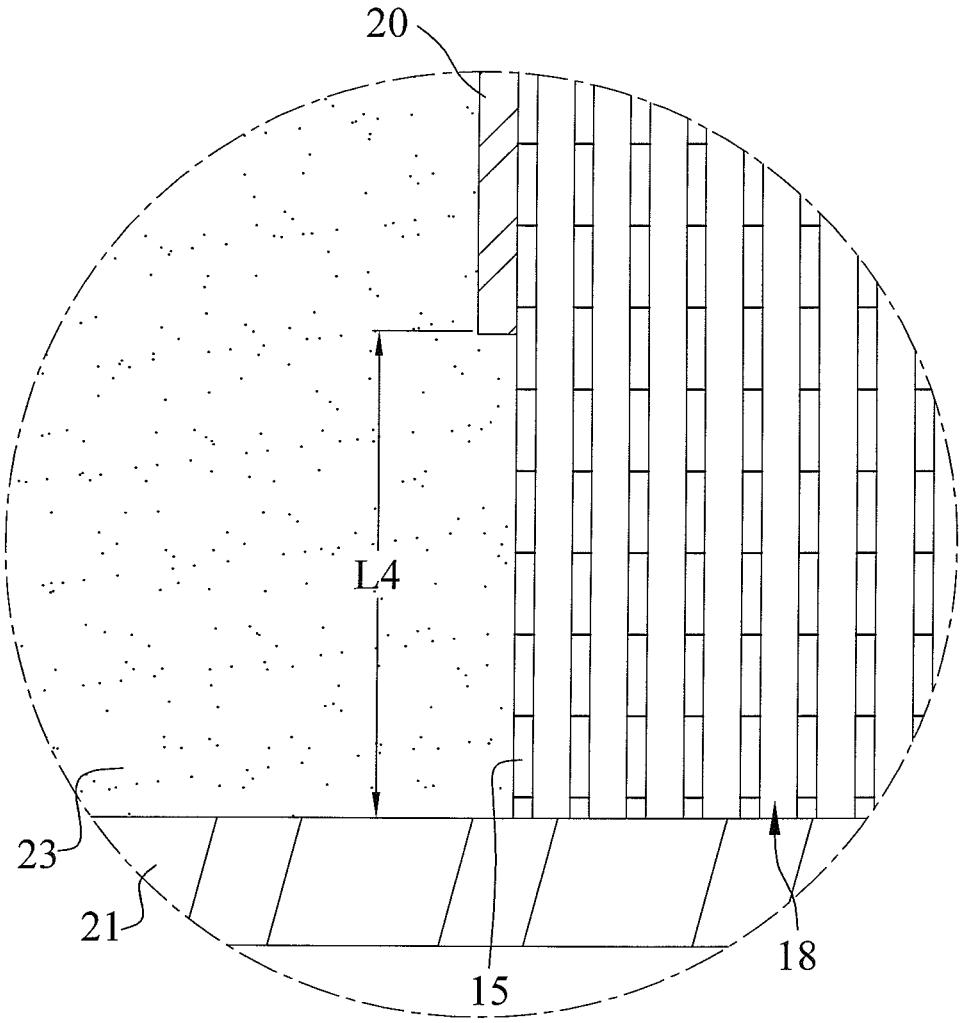
FIG. 7 shows a partial, enlarged cross-section view of FIG. 6.
Figure 8:
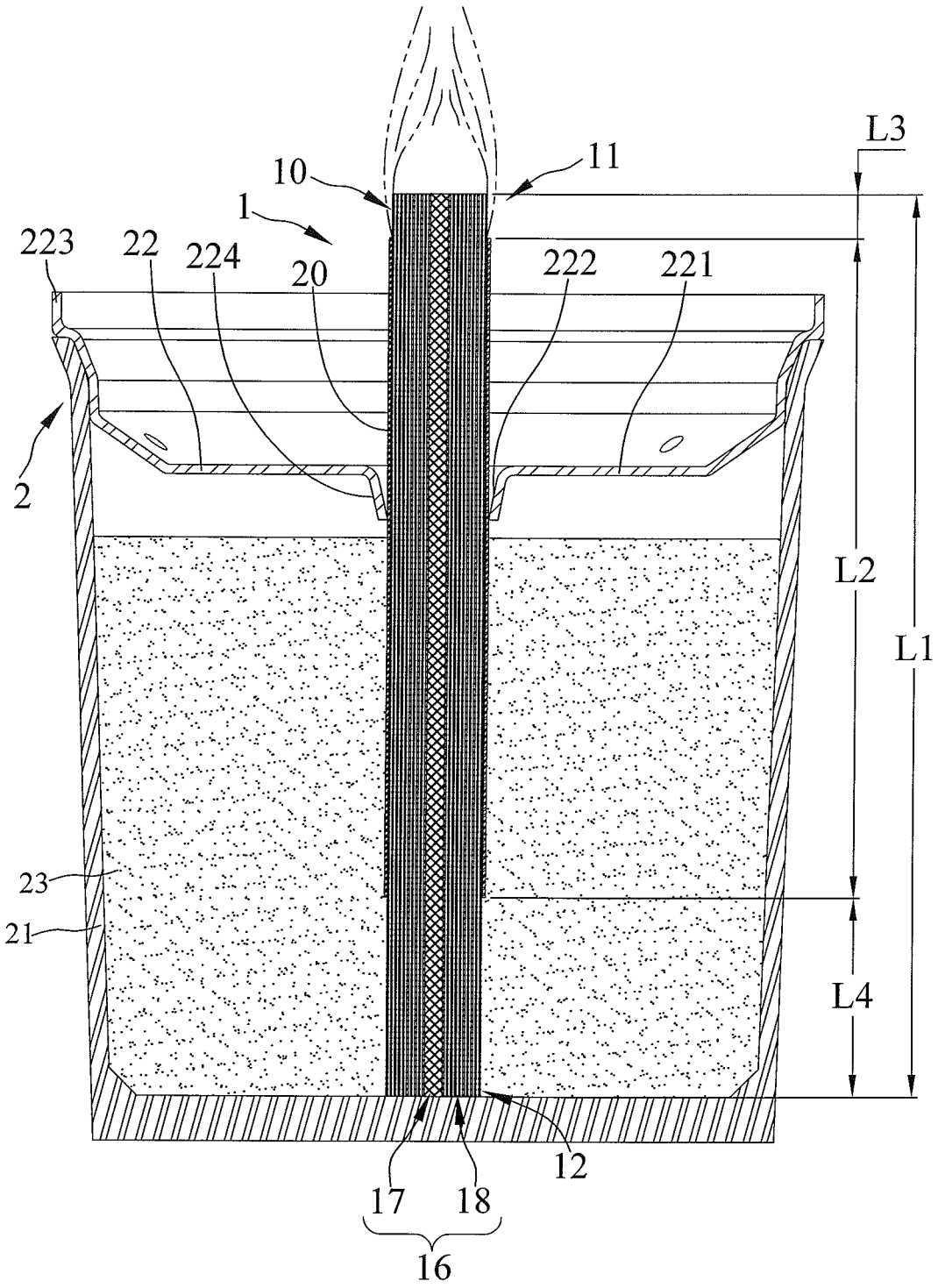
FIG. 8 shows a cross-section view of FIG. 4, and illustrates the flame scale being smaller.
Figure 9:
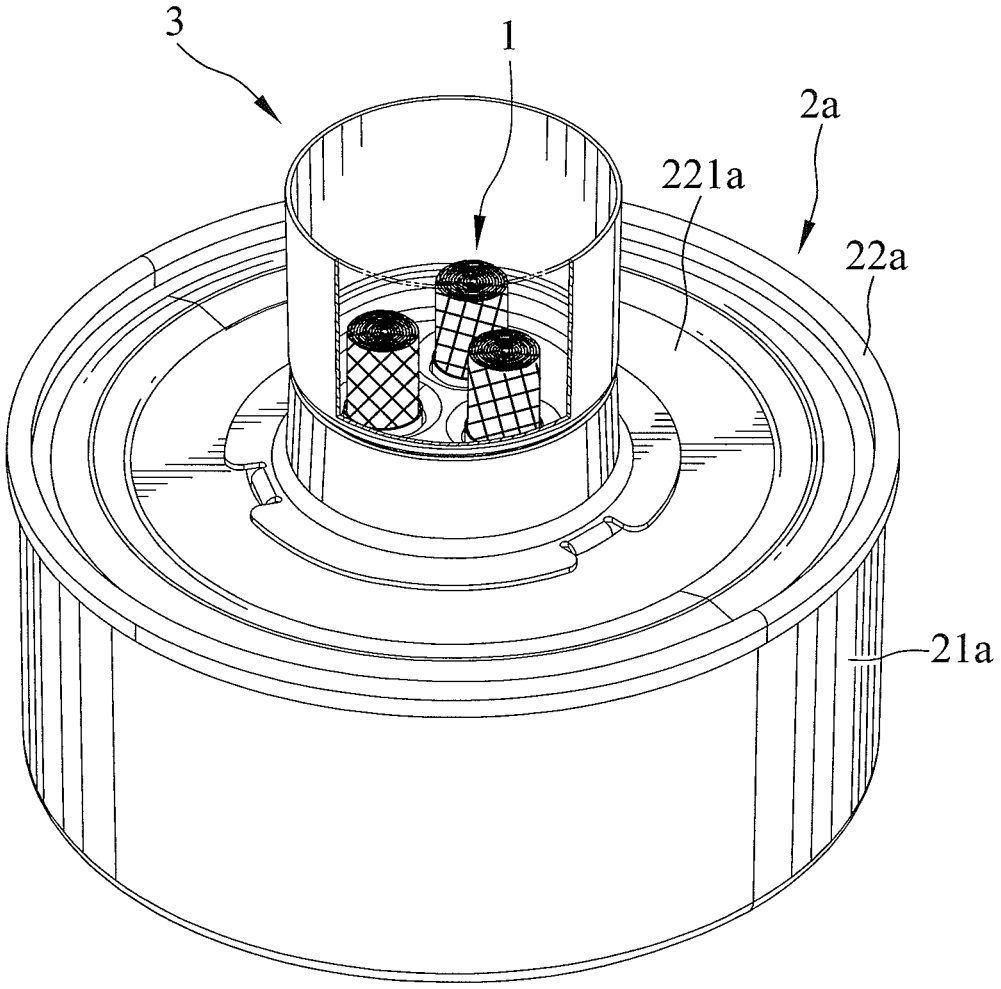
FIG. 9 shows a perspective view of the metallic wick of FIG. 1, and illustrates three metallic wicks mounted to another lamp device.
Figure 10:
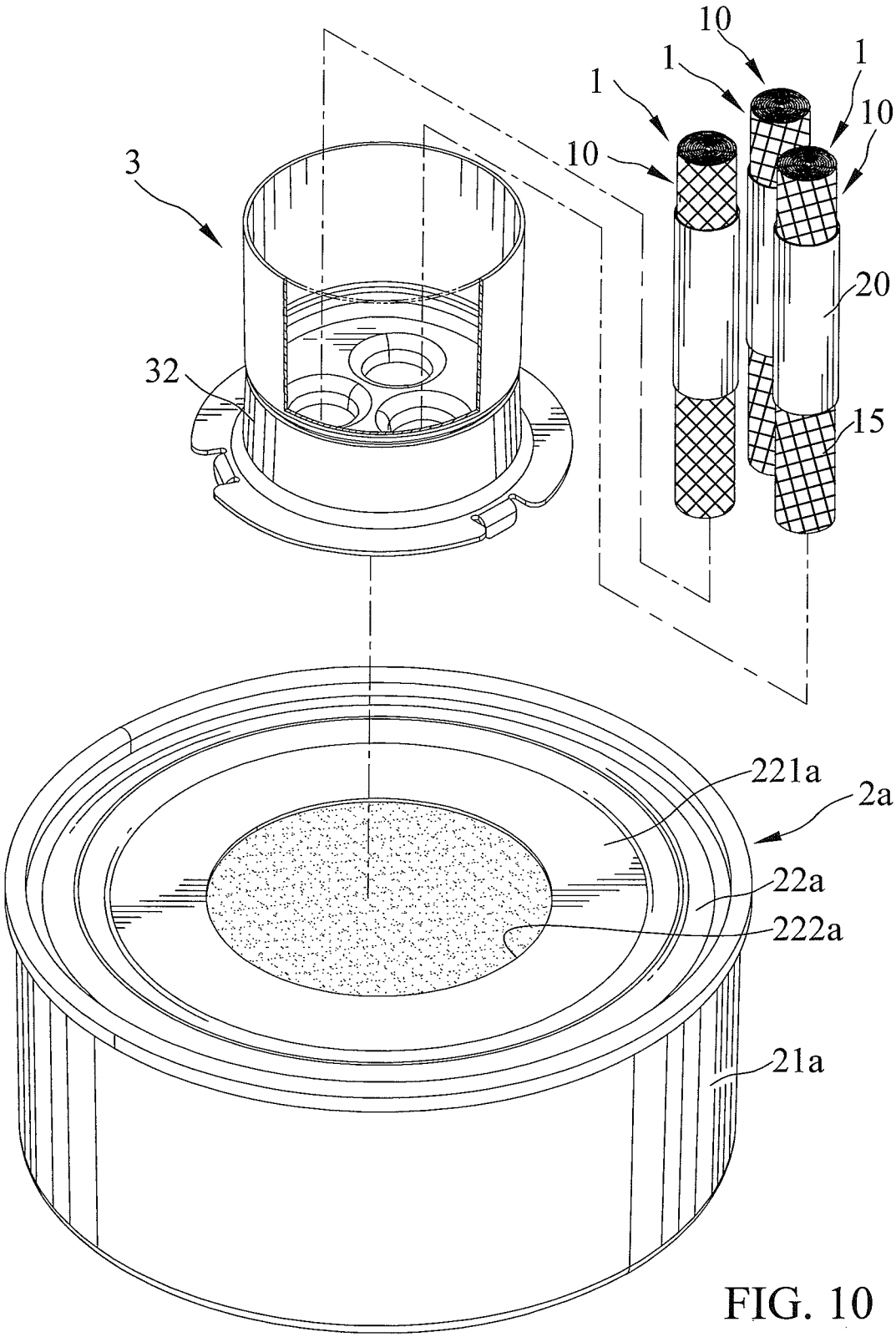
FIG. 10 shows an exploded, perspective view of the metallic wick of FIG. 9.
Figure 11:
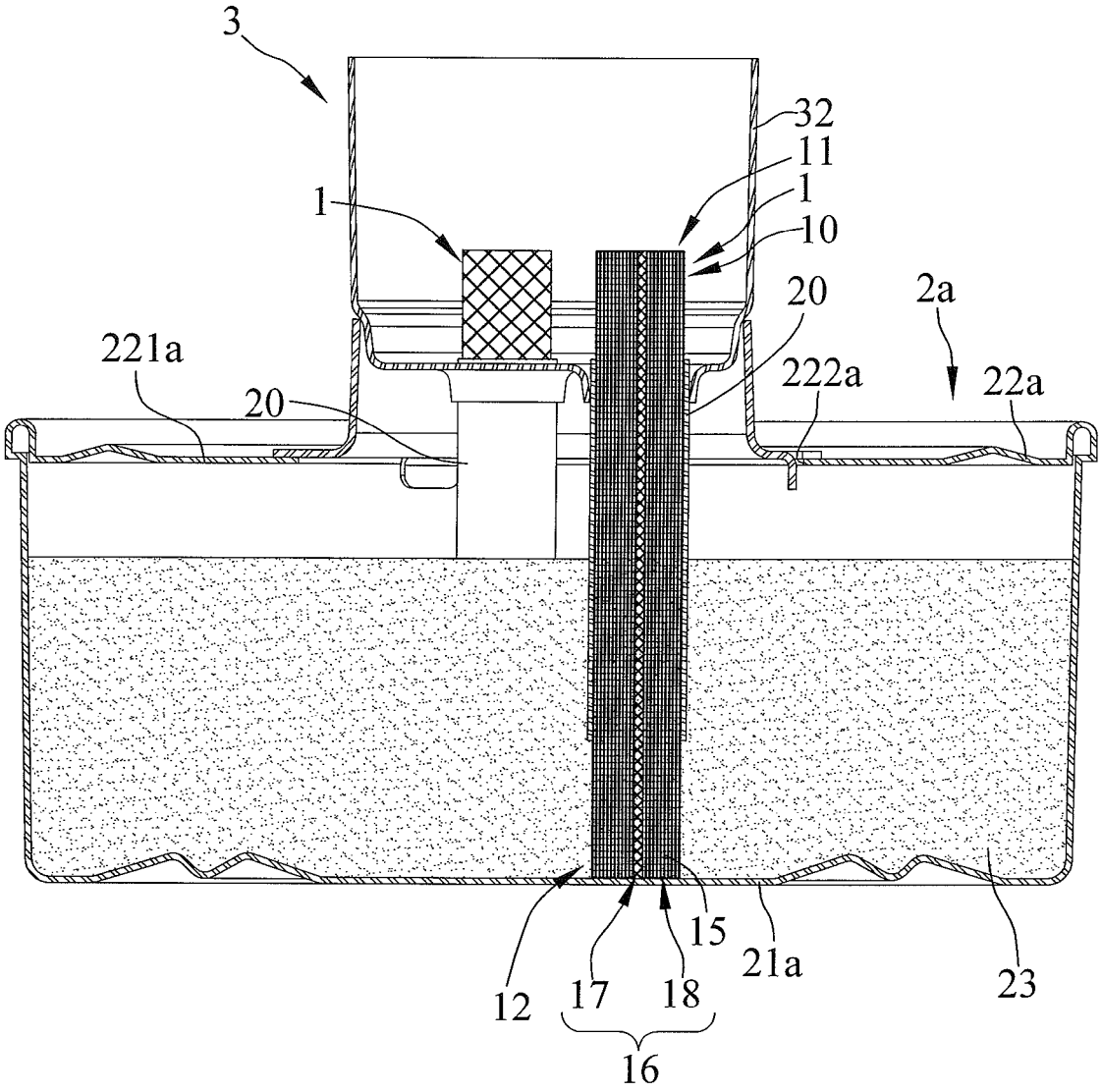
FIG. 11 shows a cross-section view of FIG. 9.
Figure 12:
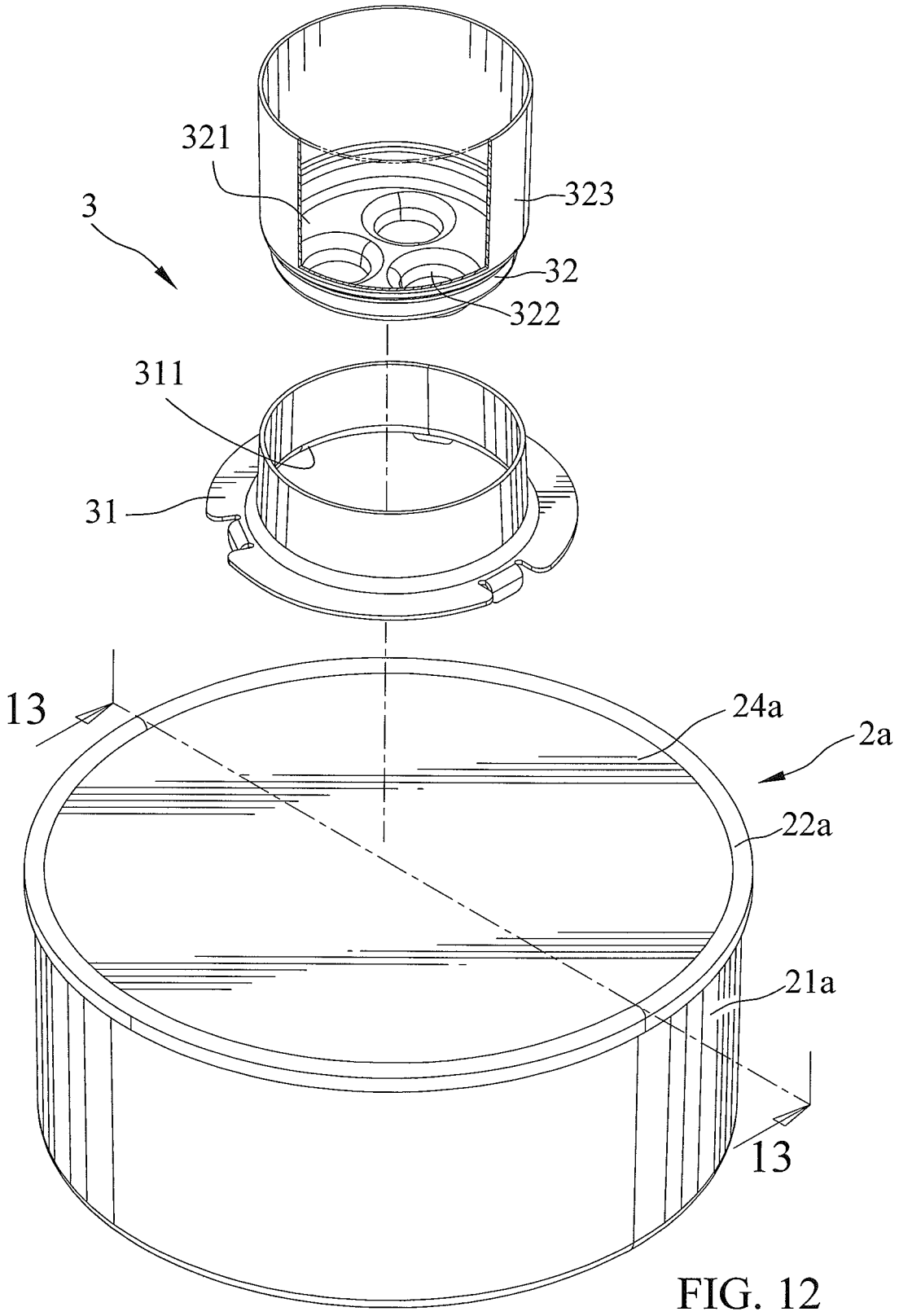
FIG. 12 shows an exploded, perspective view of the lamp device of FIG. 9.
Figure 13:
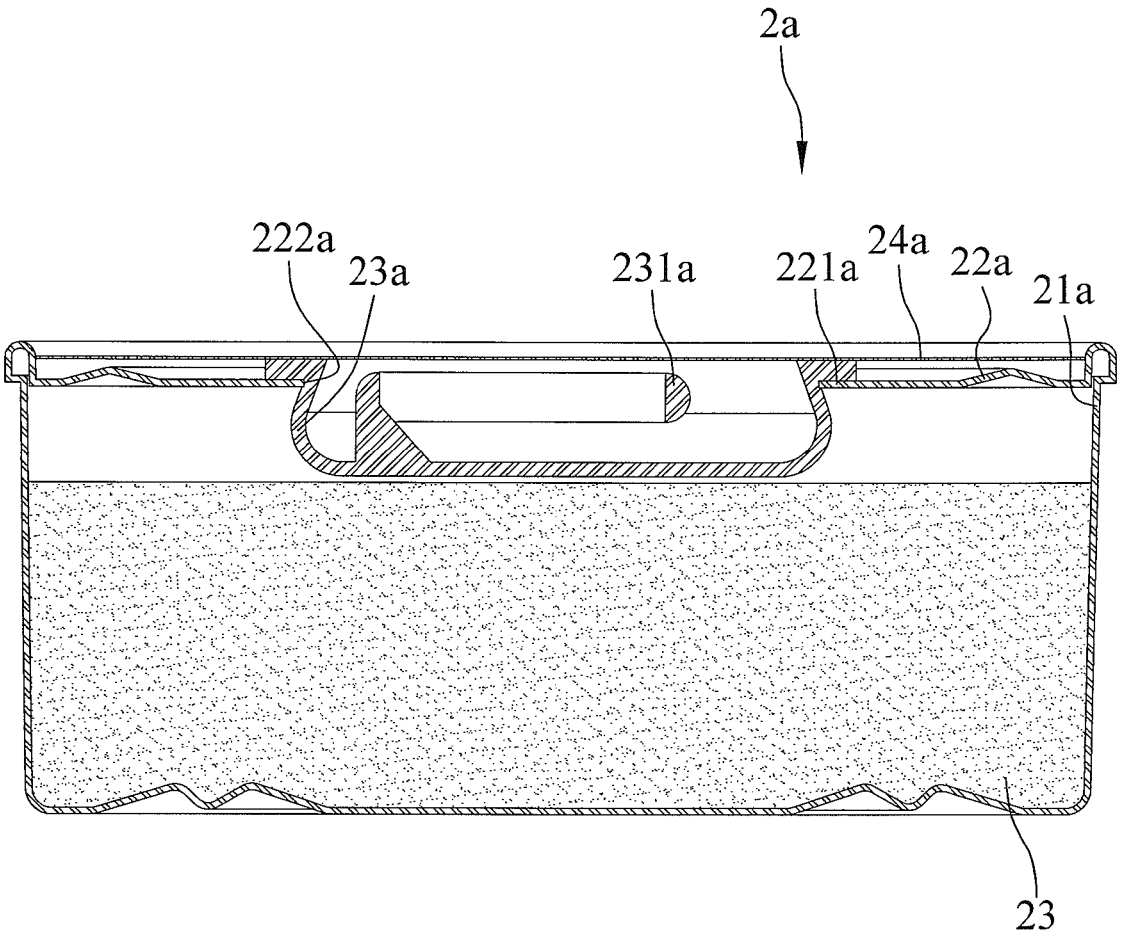
FIG. 13 shows a cross-section view taken along line 13-13 of FIG. 12.
Figure 14:
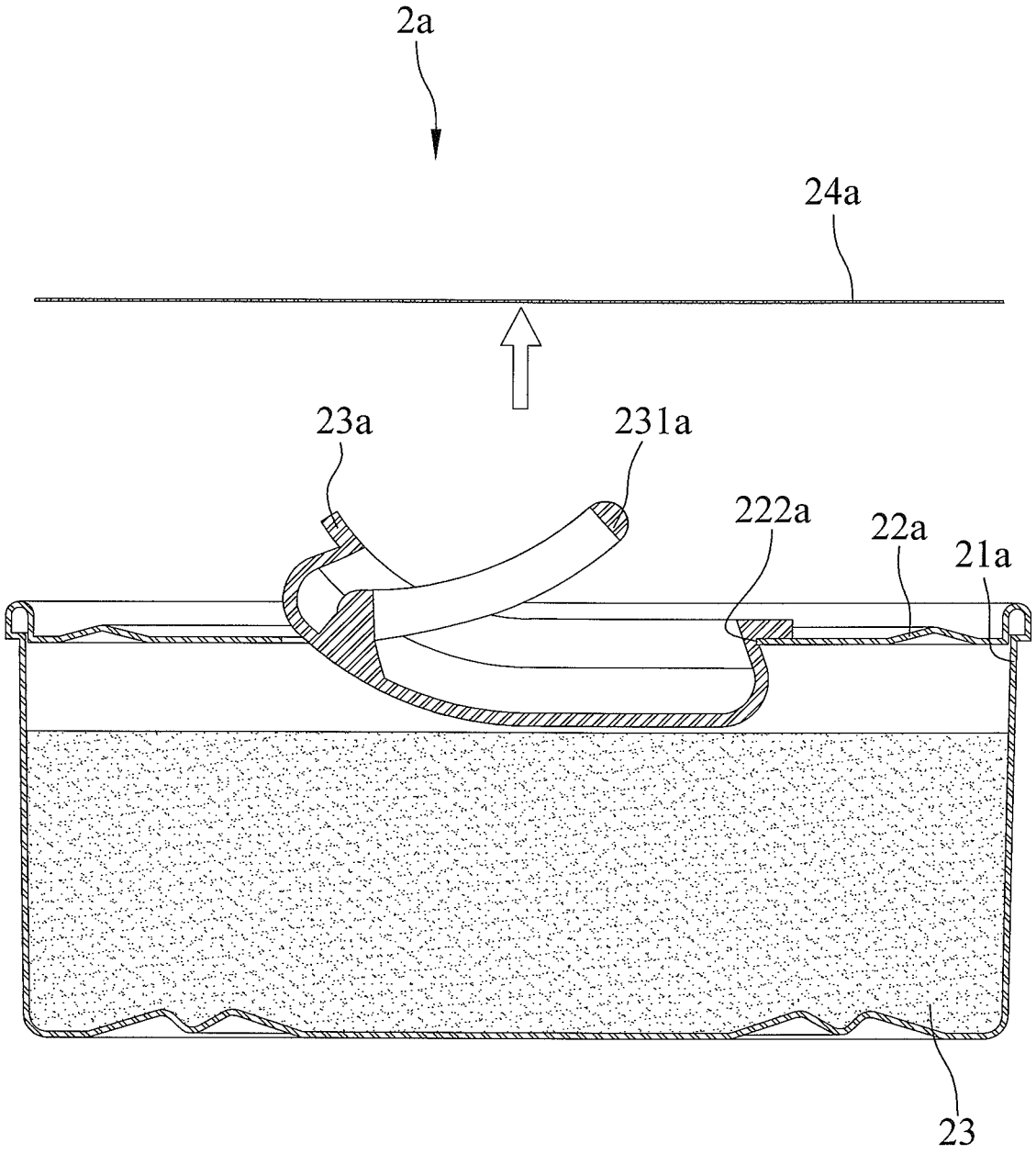
FIG. 14 shows a continued view of FIG. 13, and illustrates a film detached from a cap of the lamp device.
Figure 15:
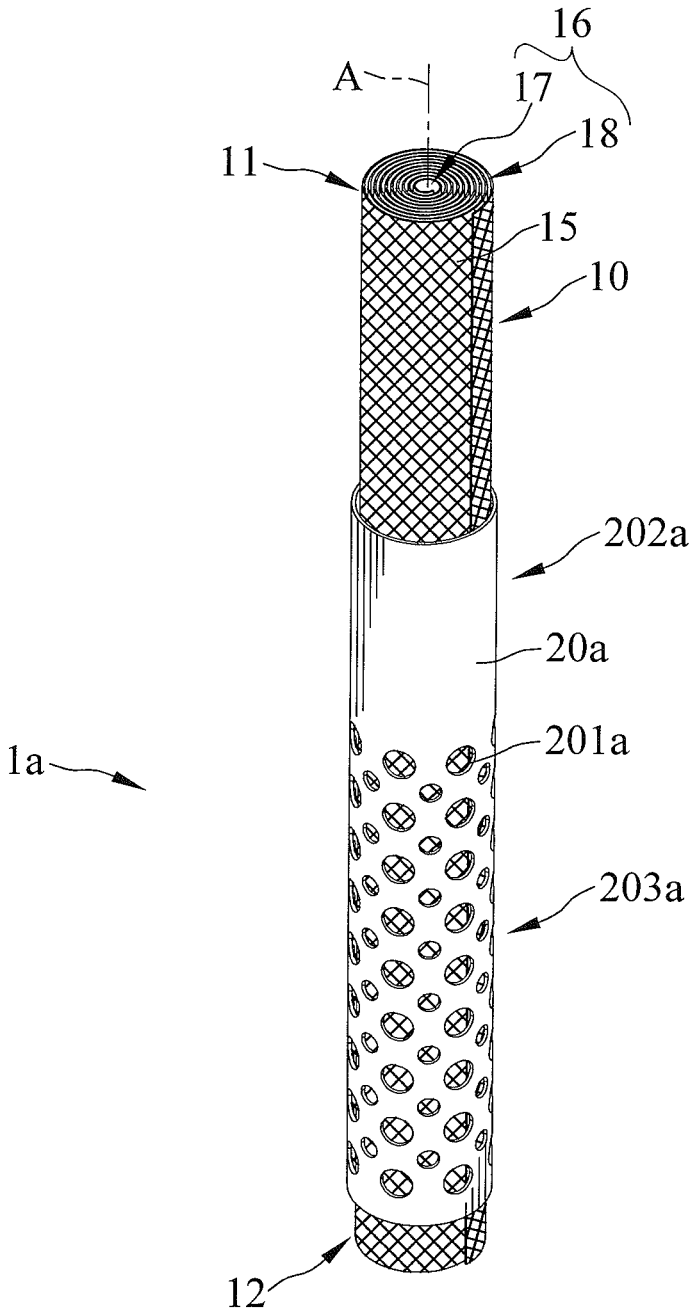
FIG. 15 shows a perspective view of a metallic wick assembly of a second embodiment according to the present invention.
Figure 16:
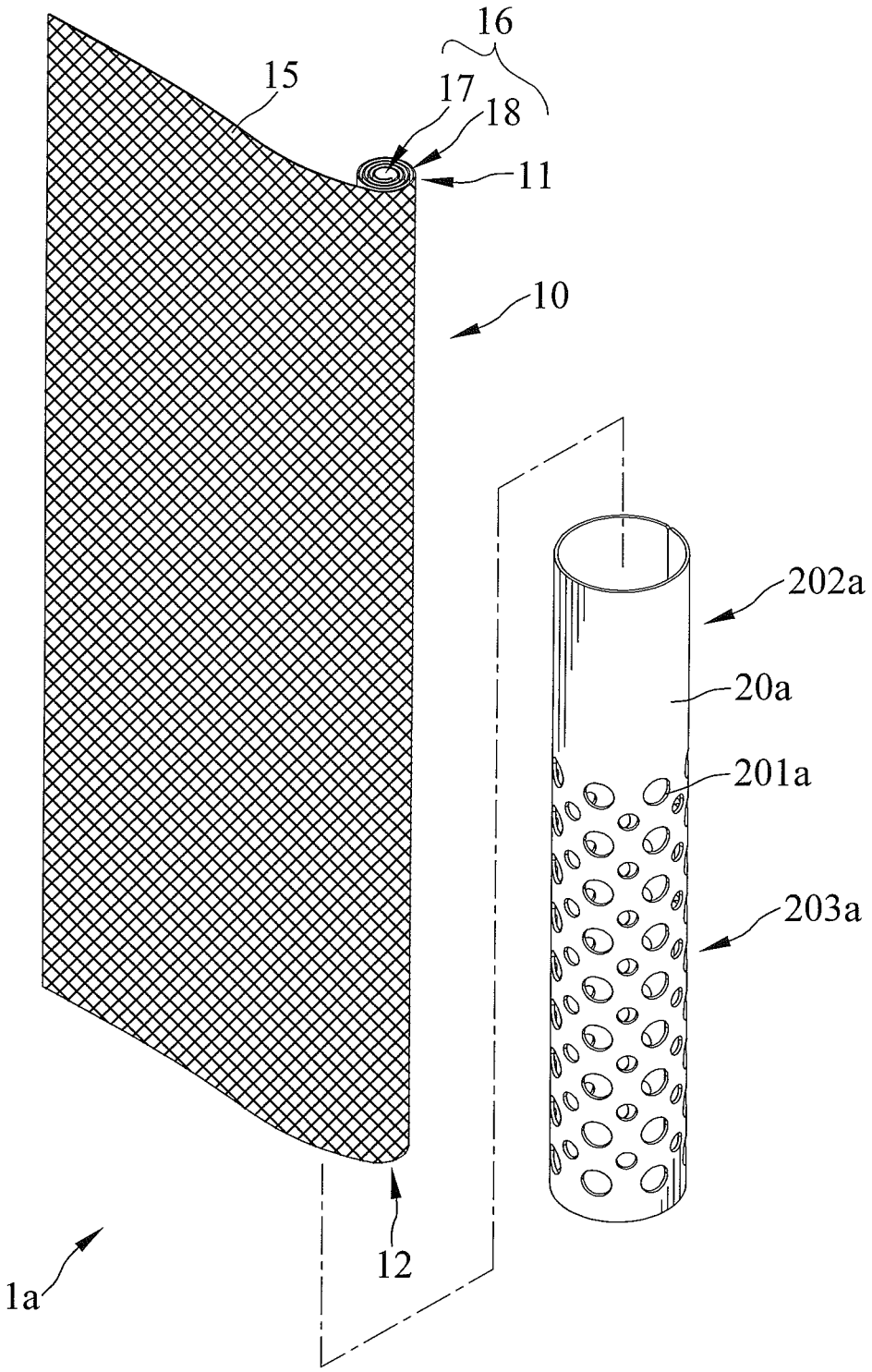
FIG. 16 shows an exploded, perspective view of the metallic wick assembly of FIG. 15.
Figure 17:
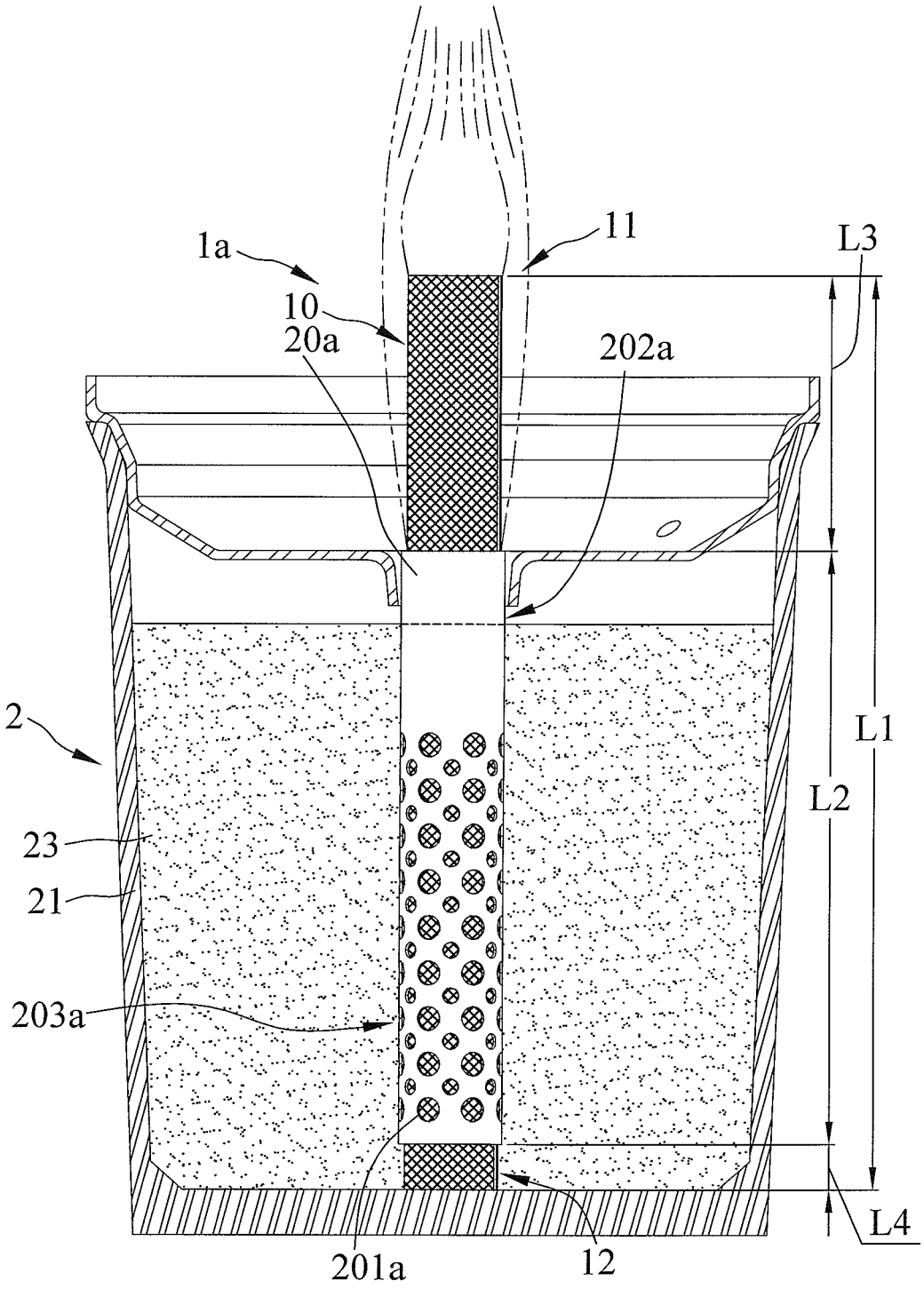
FIG. 17 shows a perspective view of the metallic wick assembly of FIG. 15, and illustrates the metallic wick assembly mounted to the lamp device and the flame scale being larger.
Figure 18:
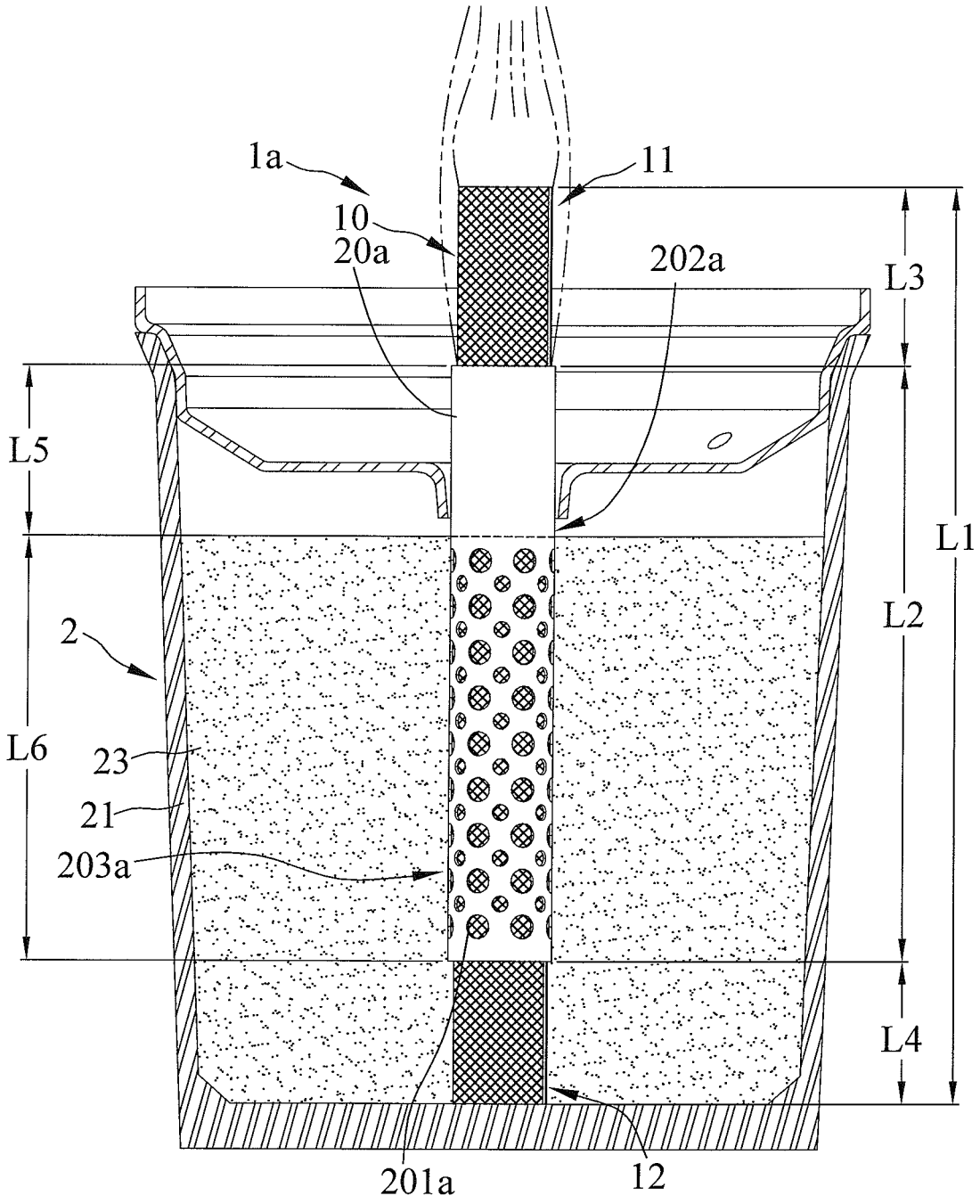
FIG. 18 shows a perspective view of the metallic wick assembly of FIG. 15, and illustrates the metallic wick assembly mounted to a lamp device and the flame scale being smaller.

FIGS. 1 through 3 show a first embodiment of a metallic wick assembly according to the present invention. The metallic wick assembly 1 generally includes a mesh member 10 and a sleeve member 20 mounted around the mesh member 10. The mesh member 10 is rolled into a tubular shape having a plurality of circles spaced from each other along a longitudinal axis A to form an Archimedean spiral cross-section perpendicular to the longitudinal axis A. The mesh member 10 includes first and second ends 11 and 12 disposed opposite to each other along the longitudinal axis A, and first and second surfaces 13 and 14 respectively extended from the first end 11 to the second end 12 thereof and arranged opposite to each other. Furthermore, the mesh member 10 essentially includes a plurality of metallic wires interlacing and overlapping each other to form into a plurality of meshes 15 penetrating the first and second surfaces 13 and 14 between the first and second ends 11 and 12 thereof. Each of the plurality of meshes 15 is formed in a quadrilateral shape, such as square or rhombus. Moreover, the mesh member 10 has the plurality of circles winding around the longitudinal axis A at continuously increasing radial distance from the longitudinal axis A to form a transport channel 16 extending from the first end 11 to the second end 12 thereof along the longitudinal axis A. The transport channel 16 includes a central section 17 disposed adjacent to the longitudinal axis A and an annular section 18 connected with and winding around the central section 17. The first surface 13 of the innermost one of the plurality of circles is arranged around the longitudinal axis A to form the central section 17. The first and second surfaces 13 and 14 of the other circles face each other, except the innermost one is defined with the annular section 18. The first surface 13 of the outermost one of the plurality of circles is connected with and abutted against the second surface 14 of the other circle arranged adjacent to the outermost one.

The sleeve member 20 is made of metal and is formed in a tubular shape. The sleeve member 20 is slidably mounted around the mesh member 10 to prevent the mesh member 10 restored from the tubular shape to have a flat shape. Moreover, the second surface 14 of the mesh member 10 is closely abutted against an inner periphery of the sleeve member 20 by an elastic restoring force thereof to prevent the mesh member 10 inadvertently sliding with respect to the sleeve member 20.

FIGS. 4 through 8 show the mesh member 10 cut into a predetermined length and the metallic wick assembly 1 mounted to a lamp device 2. The lamp device 2 includes a fuel tank 21 and a cap 22 removably mounted on an open end of the fuel tank 21. The cap 22 has an essentially circular cross section and includes a bottom portion 221, a through hole 222 longitudinally extending through the bottom portion 221, an annular wall portion 223 formed around a periphery of the bottom portion 221, and an abutted portion 224 formed around a periphery of the through hole 222 and extending opposite to the bottom portion 221. The metallic wick assembly 1 is inserted through the through hole 222 of the cap 22 and contacts with fuel 23 stored in the fuel tank 21. The bottom portion 221 hinders the flame produced at the first end 11 to ignite fuel 23. The annular wall portion 223 provides a windproof function. The abutted portion 224 abuts against the metallic wick assembly 1 to maintain the metallic wick assembly 1 in an upright position. Thus, fuel 23 is drawn from the second end 12 to the first end 11 of the metallic wick assembly 1 via the transport channel 16 by capillary action between the plurality of meshes 15 and the central and annular sections 17 and 18 to reach the flame produced at the first end 11, and, then, it vaporizes and combusts. Moreover, the size of each of the plurality of meshes 15 is unchanged or only has a very small deformation when the mesh member 10 is rolled into the plurality of circles, so that appearance factors of the metallic wick assembly 1, such as height and diameter are practically unchanged to cause the metallic wick assembly 1 to precisely maintain the flame scale during combustion. Furthermore, the transport channel 16 can be adjusted to transfer fuel 23 quickly for igniting, even for high viscosity fuels.

Furthermore, the mesh member 10 includes a first length L1 defined between the first and second ends 11 and 12 thereof. The sleeve member 20 includes a second length L2 defined between two longitudinal opposite ends thereof. The second length L2 of the sleeve member 20 is less than the first length L1 of the mesh member 10.

A third length L3 is defined between a distal end of the sleeve member 20 and the first end 11 of the mesh member 10. A fourth length L4 is defined between another distal end of the sleeve member 20 arranged adjacent to the second end 12 of the mesh member 10 and a bottom surface of the fuel tank 21 to provide fuel 23 entering into the mesh member 10. Additionally, the fourth length L4 is greater than zero. Moreover, the sleeve member 20 is slidable with respect to the mesh member 10 to adjust the third length L3 for controlling the flame scale. When the third length L3 is greater (shown in FIG. 6), the first end 11 of the mesh member 10 can contact with more air to cause fuel 23 igniting and reacting with more oxygen, so that the flame scale is larger. Conversely, when the third length L3 is less (shown in FIG. 8), the first end 11 of the mesh member 10 can contact with less air to cause fuel 23 igniting and reacting with less oxygen, so that the flame scale is smaller. The fourth length L4 is changed in relation to the third length L3 to provide fuel 23 entering into the mesh member 10.

FIGS. 9 through 14 show three metallic wick assemblies 1 respectively cut into a predetermined length and mounted to another lamp device 2*a*. The lamp device 2*a* includes a fuel tank 21*a* and a cap 22*a* formed integrally as a single piece. The cap 22*a* has an essentially circular cross section and includes a bottom portion 221*a* and a through hole 222*a* longitudinally extending through the bottom portion 221*a*. A pull tab 23*a* is removably connected to close the through hole 222*a* to avoid fuel 23 leaking out of the fuel tank 21*a*. The pull tab 23*a* has a ring 231*a*. A film 24*a* is removably connected to one end of the cap 22*a* and opposite to the bottom portion 221*a*. A user can hook his/her finger through the ring 231*a* and remove the pull tab 23*a* from the through hole 222*a*, so that the through hole 222*a* is interconnected with an open end of the fuel tank 21*a*.

The lamp device 2*a* further includes a supporting assembly 3 mounted on the cap 22*a*. The supporting assembly 3 includes a fixing member 31 and a shield member 32. The fixing member 31 is connected to the bottom portion 221*a* of the cap 22*a* and has a through bore 311 communicated with the through hole 222*a* of the cap 22*a*. The shield member 32 is mounted into the through bore 311 of the fixing member 31. The shield member 32 includes a bottom section 321, three connecting holes 322 longitudinally extending through the bottom section 321, and a wall section 323 formed around a periphery of the bottom section 321. The three connecting holes 322, the through hole 222*a* of the cap 22*a*, and the open end of the fuel tank 21*a* are interconnected to each other, and the three metallic wick assemblies 1 respectively insert therethrough. Thus, fuel 23 is drawn from the second end 12 to the first end 11 of each of the three metallic wick assemblies 1 via the transport channel 16 by capillary action between the plurality of meshes 15. The bottom section 321 hinders the flame produced at the first end 11 to ignite fuel 23. The wall section 323 provides a windproof function.

FIGS. 15 through 18 show a second embodiment of the metallic wick assembly. Specifically, the second embodiment of the metallic wick assembly 1*a* generally includes a mesh member 10 and a sleeve member 20*a* mounted around the mesh member 10. The structure of the mesh member 10 is similar to the first embodiment substantially.

The sleeve member 20*a* is made of metal and formed in a tubular shape. The sleeve member 20*a* is slidably mounted around the mesh member 10 and has a plurality of apertures 201*a*. The sleeve member 20*a* has delimited first and second sections 202*a* and 203*a* at two opposite ends thereof. The plurality of apertures 201*a* is arranged at the first section 202*a* to provide fuel 23 passing therethrough and drawn up freely to the first end 11 of the mesh member 10. The first section 202*a* of the sleeve member 20*a* is arranged adjacent to the first end 11 of the mesh member 10 and has a fifth length L5. The second section 203*a* of the sleeve member 20*a* is arranged adjacent to the second end 12 of the mesh member 10 and has a sixth length L6. The fifth length L5 is less than the sixth length L6 (shown in FIG. 12). In a preferred form, the range of the ratio of the fifth length L5 to the sixth length L6 is 0.3 to 0.5.

Figure 19:
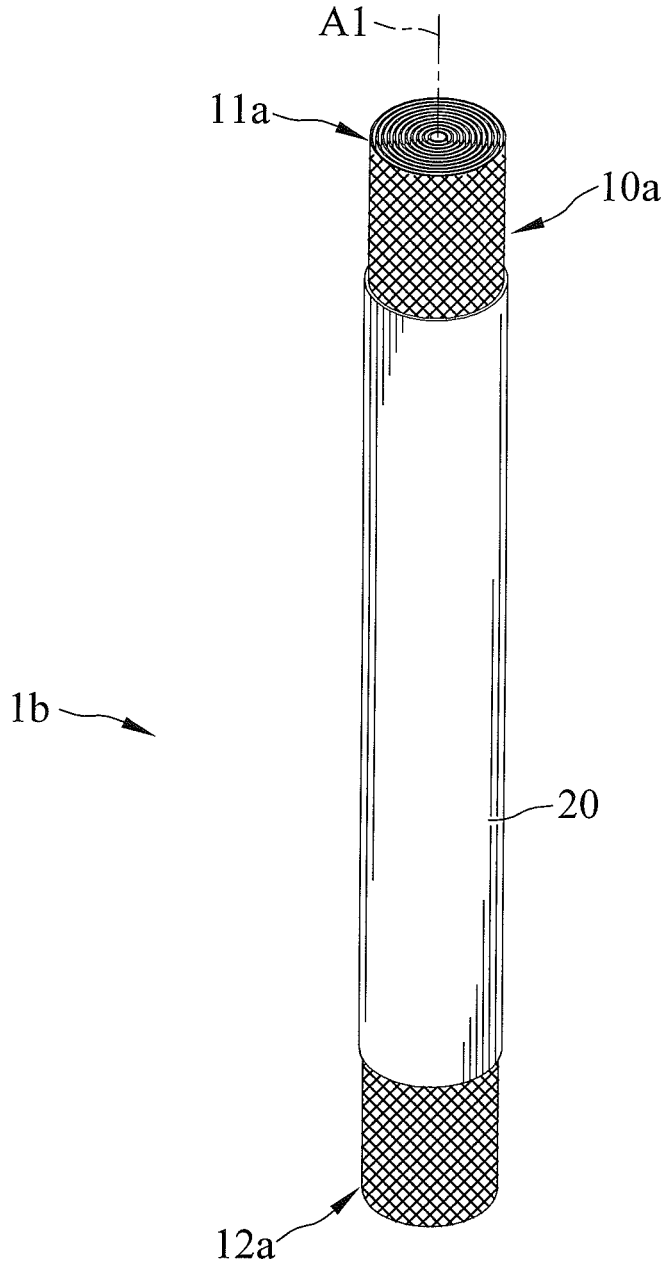
FIG. 19 shows a perspective view of a metallic wick assembly of a third embodiment according to the present invention.
Figure 20:
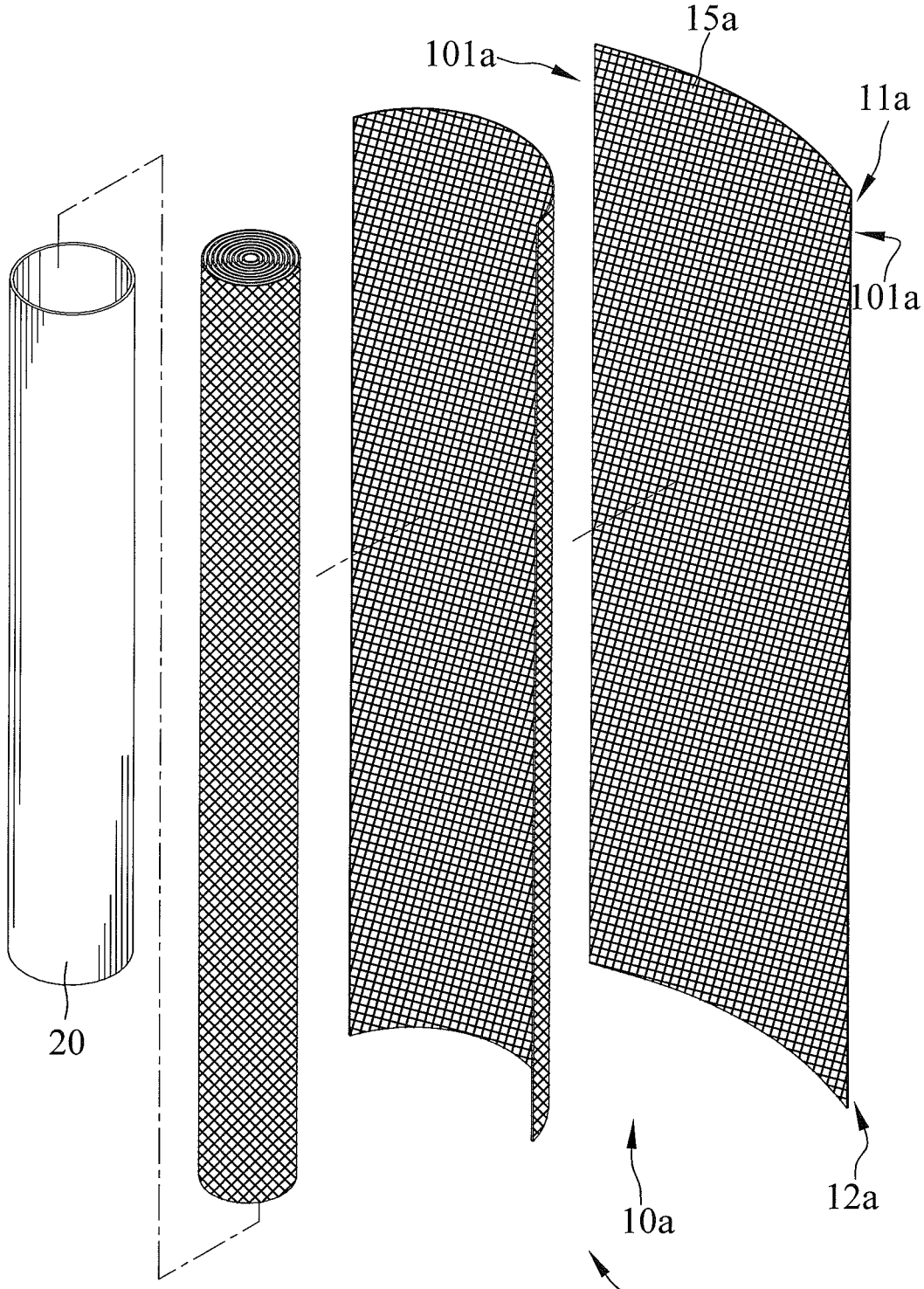
FIG. 20 shows an exploded, perspective view of the metallic wick assembly of FIG. 19.
Figure 21:
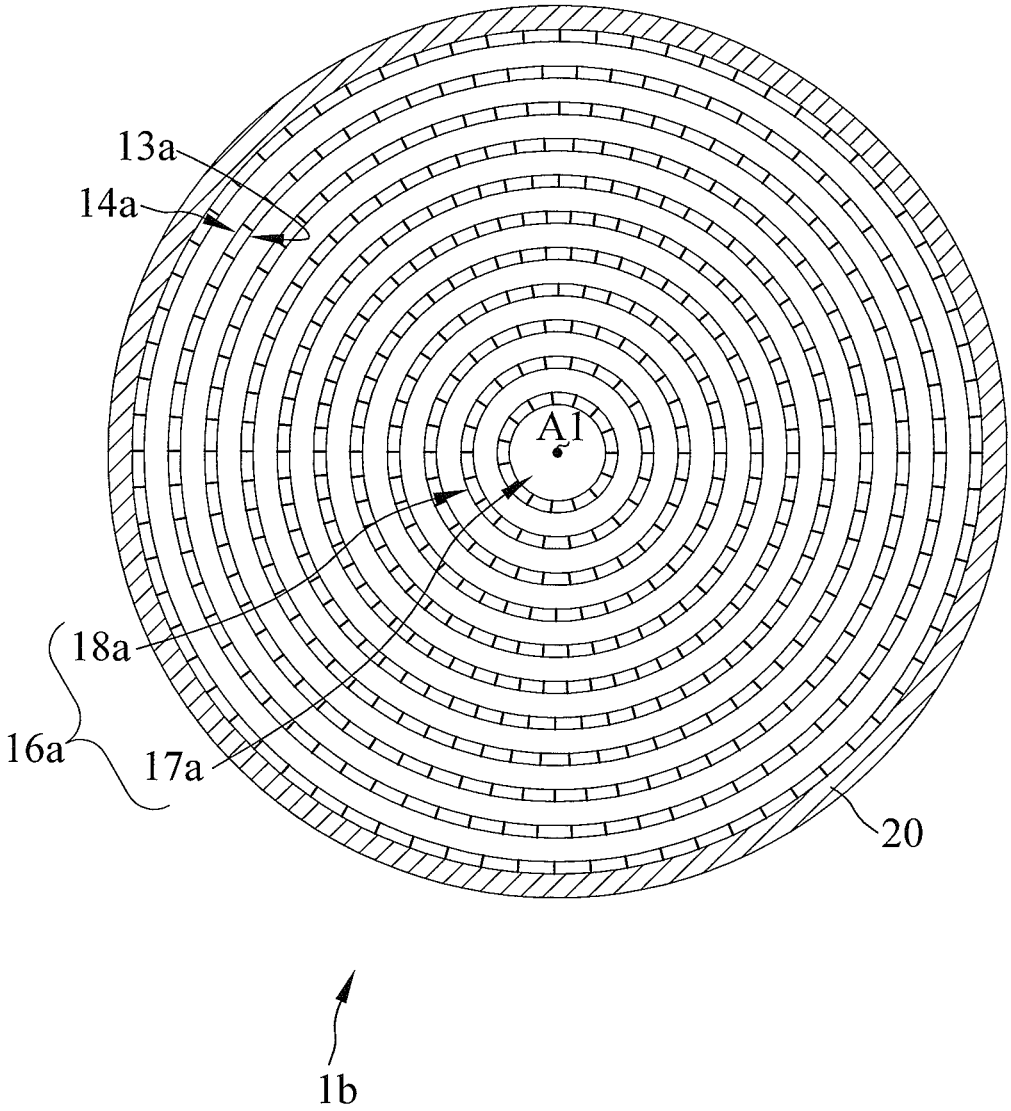
FIG. 21 shows a cross-section view of the metallic wick assembly of FIG. 19.

FIGS. 19 through 21 show a third embodiment of the metallic wick assembly. Specifically, the third embodiment of the metallic wick assembly 1*b* generally includes a plurality of mesh members 10*a* and a sleeve member 20 mounted around the plurality of mesh members 10*a*. The structure of the mesh member 10*a* is similar to the first embodiment substantially. The plurality of mesh members 10*a* is respectively rolled into the plurality of different-sized tubes assembled and radially spaced from each other along a longitudinal axis A1 to form a concentric circular cross section perpendicular to the longitudinal axis A1. Each of the plurality of mesh members 10*a* includes first and second ends 11*a* and 12*a* disposed opposite to each other along the longitudinal axis A1, and first and second surfaces 13*a* and 14*a* respectively extended from the first end 11*a* to the second end 12*a* thereof and arranged opposite to each other. Each of the plurality of mesh members 10*a* further includes two side edges 101*a* extending from the first end 11*a* to the second end 12*a* and connected with each other. Furthermore, each of the plurality of mesh members 10*a* essentially includes a plurality of metallic wires interlacing and overlapping each other to form into a plurality of meshes 15*a* penetrating between the first and second ends 11*a* and 12*a* thereof. Each of the plurality of meshes 15*a* is formed in a rhombus shape. Moreover, the plurality of mesh members 10*a* are radially spaced from each other to form a transport channel 16*a* extending from the first end 11*a* to the second end 12*a* thereof along the longitudinal axis A1. The transport channel 16*a* includes a central section 17*a* disposed adjacent to the longitudinal axis A1 and a plurality of annular sections 18*a* surrounding the central section 17*a*. The first surface 13*a* of the innermost one of the plurality of mesh members 10*a* arranged around the longitudinal axis A1 to form the central section 17*a*. The first and second surfaces 13*a* and 14*a* of the other mesh members 10*a* face and are spaced from each other, except the innermost one is defined with the annular sections 18*a*.

Figure 22:
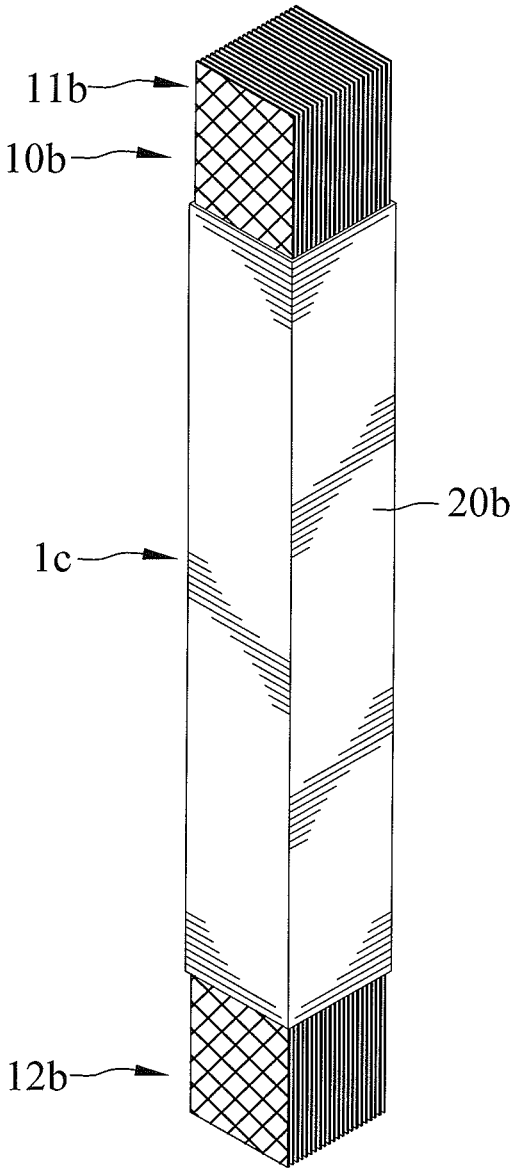
FIG. 22 shows a perspective view of a metallic wick assembly of a fourth embodiment according to the present invention.
Figure 23:
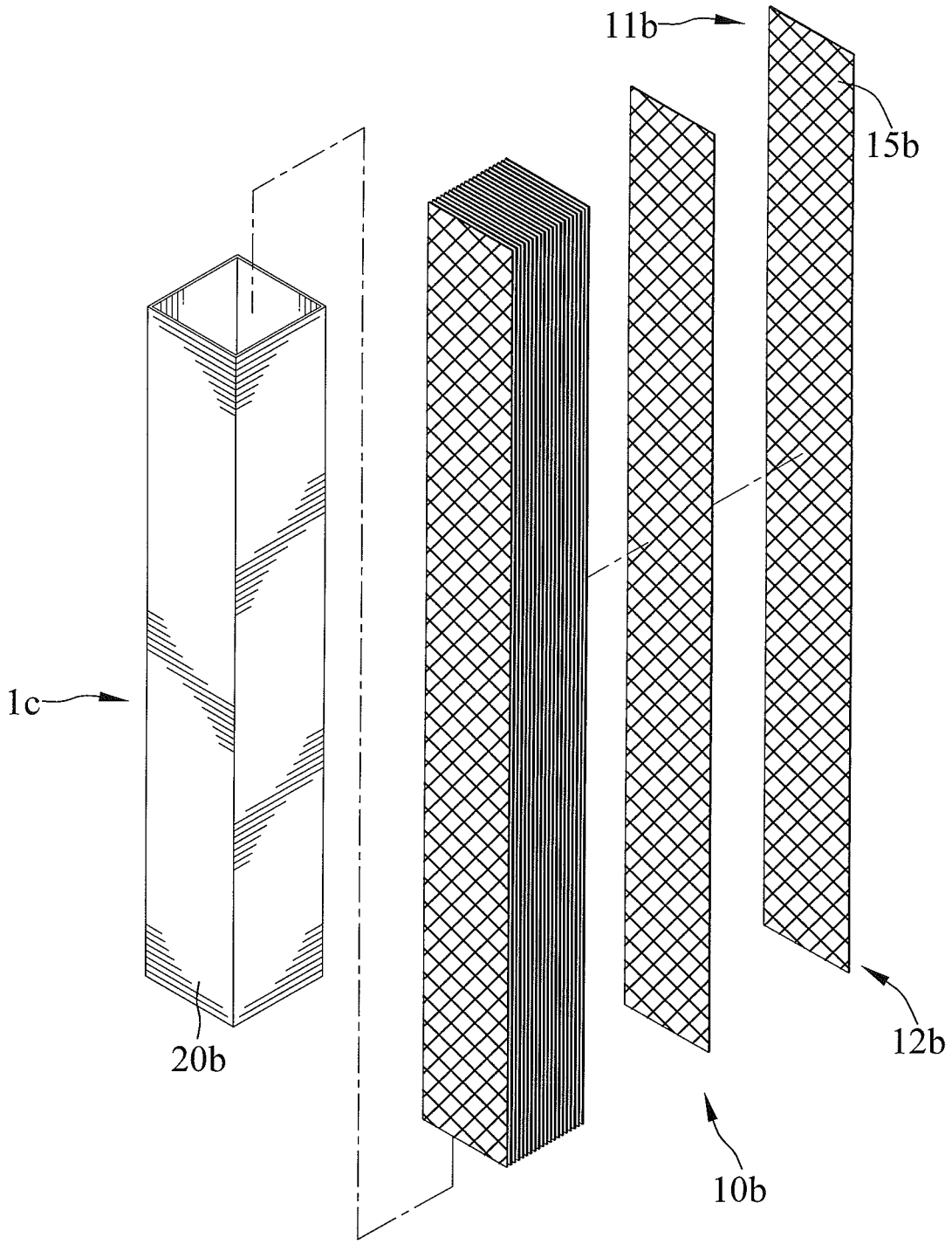
FIG. 23 shows an exploded, perspective view of the metallic wick assembly of FIG. 22.
Figure 24:
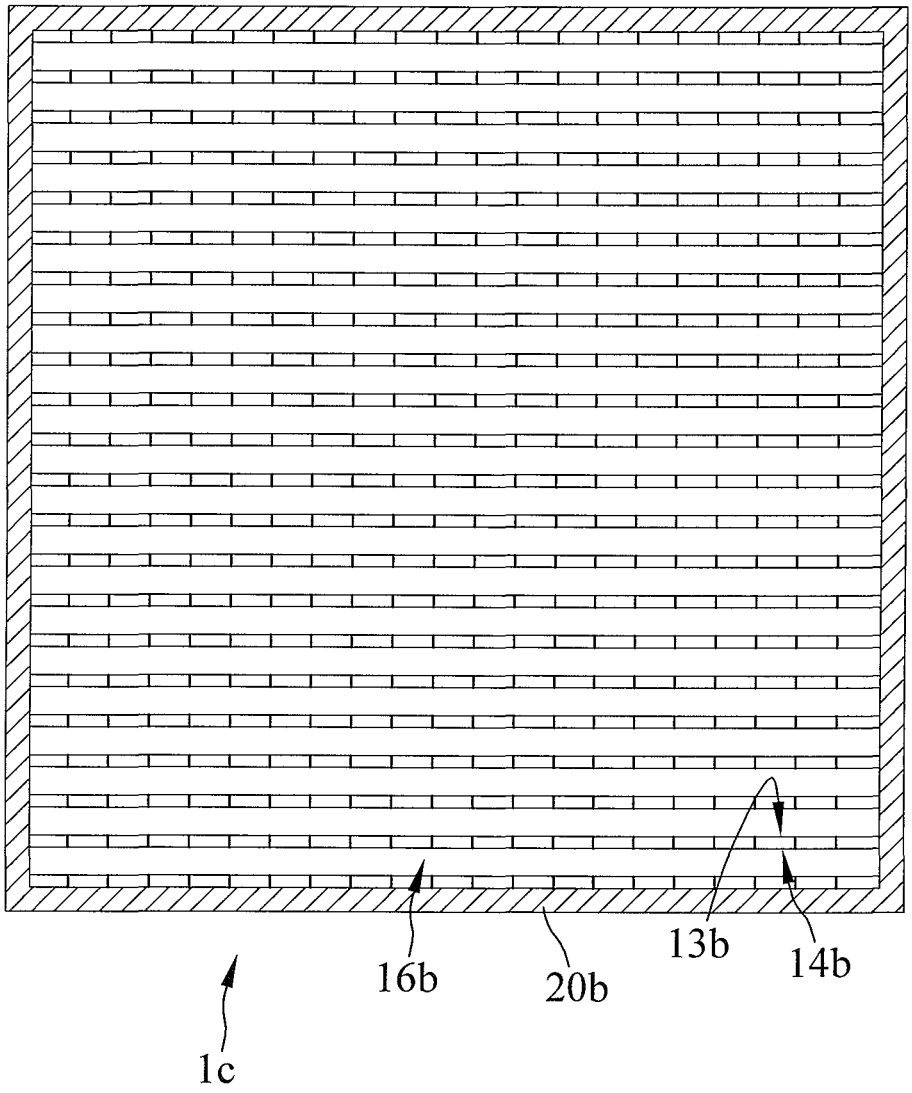
FIG. 24 shows a cross-section view of the metallic wick assembly of FIG. 22.

FIGS. 22 through 24 show a fourth embodiment of the metallic wick assembly. Specifically, the fourth embodiment of the metallic wick assembly 1*c* generally includes a plurality of mesh members 10*b* and a sleeve member 20*b* mounted around the plurality of mesh members 10*b*. The plurality of mesh members 10*b* are spaced from each other and arranged in a longitudinal stacked array to form a rectangular cross section. Each of the plurality of mesh members 10*b* is formed in a flat shape and includes first and second ends 11*b* and 12*b* disposed opposite to each other, and first and second surfaces 13*b* and 14*b* respectively extended from the first end 11*b* to the second end 12*b* thereof and are arranged opposite to each other. Furthermore, each of the plurality of mesh members 10*b* essentially includes a plurality of metallic wires interlacing and overlapping each other to form into a plurality of meshes 15*b* penetrating between the first and second ends 11*b* and 12*b* thereof. Moreover, the plurality of mesh members 10*b* is spaced from each other to form a transport channel 16*b* extending from the first end 11*b* to the second end 12*b* thereof.

The sleeve member 20*b* is made of metal and formed in a rectangular tubular shape corresponding to the rectangular cross section of the mesh member 10*b*. The sleeve member 20*b* is slidably mounted around the mesh member 10*b* to prevent the plurality of mesh members 10*b* from becoming unassembled with each other.

The metallic wick according to the present invention includes the following advantages:

1. The metallic wick assembly 1; 1*a*; 1*b*; 1*c* includes the sleeve member 20; 20*a*; 20*b* slidable with respect to the mesh member 10; 10*a*; 10*b* to adjust the third length L3 for controlling the flame scale.

2. The metallic wick assembly 1; 1*a*; 1*b*; 1*c* includes the sleeve member 20; 20*a*; 20*b* slidably mounted around the mesh member 10; 10*a*; 10*b* to prevent the mesh member 10; 10*a*; 10*b* from becoming unassembled.

3. The metallic wick assembly 1; 1*a*; 1*b*; 1*c* includes the sleeve member 20; 20*a*; 20*b* having the plurality of apertures 201*a* to allow fuel 23 to pass therethrough and to be drawn up quickly to the first end 11; 11*a*; 11*b* of the mesh member 10; 10*a*; 10*b*.

4. The metallic wick assembly 1; 1*a*; 1*b*; 1*c* includes the sleeve member 20; 20*a*; 20*b* slidably mounted around the mesh member 10; 10*a*; 10*b*, so that they are assembled with each other easily and quickly.

5. The metallic wick assembly 1; 1*a*; 1*b*; 1*c* is made of metal, so that it cannot be carbonized or consumed to maintain a fixed shape and height to maintain the flame combustion scale.

6. The metallic wick assembly 1; 1*a*; 1*b*; 1*c* includes the mesh member 10; 10*a*; 10*b* having an end producing the flame thereon and heated by the flame to cause fuel drawn to the end thereof to be vaporized and combusted more completely due to a higher wick temperature.

7. The number of circles, the size of meshes 15; 15*a*; 15*b*, the surface roughness and the coating materials of the mesh member 10; 10*a*; 10*b* are adjustable to control the ability of capillary action for wicking various fuels with different viscosity, so that the metallic wick assembly 1; 1*a*; 1*b*; 1*c* can draw more viscous fuel faster to the tip thereof and can be ignited shortly (one minute or less).

8. The metallic wick assembly 1; 1*a*; 1*b*; 1*c* does not loosen at a terminal end of the mesh member 10; 10*a*; 10*b* after cutting a predetermined length or trimming and can be mounted on the lamp device 2; 2*a* easily.

9. The metallic wick assembly 1; 1*a*; 1*b*; 1*c* is made of metal, reducing manufacturing costs to provide a popular price. In a preferred form, the mesh member 10; 10*a*; 10*b* can be formed by a common metal wire mesh, and the sleeve member 20; 20*a*; 20*b* can be formed by a common metal tube.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A metallic wick assembly comprising:

at least one mesh member including first and second ends disposed opposite to each other, first and second surfaces respectively extended from the first end to the second end thereof and arranged opposite to each other, a plurality of meshes penetrating the first and second surfaces between the first and second ends thereof, and a transport channel extending from the first end to the second end thereof, with the mesh member including a first length defined between the first and second ends thereof, a sleeve member mounted around each at least one mesh member and including a second length defined between a distal end and an longitudinal opposite end thereof, with the second length being less than the first length;

wherein a third length is defined between the distal end of the sleeve member and the first end of the at least one mesh member, with the sleeve member slidable with respect to the mesh member to adjust the third length; and a fuel tank having a through hole and a bottom, with the sleeve member received in the through hole, with the longitudinal opposite end located in the fuel tank, with the second end of the at least one mesh member located in the fuel tank and abutting with the bottom, with the first end of the at least one mesh member and the distal end of the sleeve member located outward of the fuel tank with the transport channel drawing fuel from the fuel tank by capillary action inside the sleeve member, with the third length being adjusted for controlling a flame scale.

2. The metallic wick assembly as claimed in claim 1, wherein the at least one mesh member is rolled into a tubular shape and having a plurality of circles spaced from each other along a longitudinal axis, with the plurality of circles winding around the longitudinal axis to form an Archimedean spiral cross-section perpendicular to the longitudinal axis at continuously increasing radial distance from the longitudinal axis to form the transport channel, with the sleeve member mounted around the Archimedean spiral cross-section.

3. The metallic wick assembly as claimed in claim 2, wherein the transport channel includes a central section disposed adjacent to the longitudinal axis and an annular section connected with and winding around the central section.

4. The metallic wick assembly as claimed in claim 2, further comprising a cap mounted on an open end of the fuel tank and including a bottom portion, with the through hole longitudinally extending through the bottom portion, with an annular abutted portion formed around the through hole and extending from the bottom portion towards but spaced from the bottom of the fuel tank, with the sleeve member received in the through hole and the annular abutted portion.

5. The metallic wick assembly as claimed in claim 4, wherein the sleeve member has a plurality of apertures located intermediate the bottom and the through hole of the fuel tank.

6. The metallic wick assembly as claimed in claim 4, wherein the at least one member comprises a plurality of mesh members with each including a corresponding sleeve member mounted therearound.

7. The metallic wick assembly as claimed in claim 6, further comprising a supporting assembly mounted on the cap and including a fixing member and a shield member, with the fixing member connected to the bottom portion of the cap opposite to the bottom of the fuel tank and having a through bore communicated with the through hole of the cap, with the shield member mounted into the through bore of the fixing member and including a bottom section, a connecting hole extending through the bottom section, and a wall section formed around a periphery of the bottom section, with the connecting hole, the through hole of the cap, and the open end of the fuel tank interconnected to each other.

8. The metallic wick assembly as claimed in claim 7, wherein the at least one mesh member is rolled into a tubular shape and having a plurality of circles spaced from each other along a longitudinal axis, with the plurality of circles winding around the longitudinal axis to form an Archimedean spiral cross-section perpendicular to the longitudinal axis at continuously increasing radial distance from the longitudinal axis to form the transport channel, with the sleeve member mounted around the Archimedean spiral cross-section.

9. The metallic wick assembly as claimed in claim 6, further comprising a closure including a pull tab, wherein the fuel tank includes a lid having a central opening, with the fixing member removably connected to the central opening, with the closure removably connected to the central opening to close the central opening to avoid fuel leaking out of the fuel tank through the central opening, with a film extending over the closure opposite to the bottom portion.

10. The metallic wick assembly as claimed in claim 6, wherein the at least one mesh member is rolled into a tubular shape and having a plurality of circles spaced from each other along a longitudinal axis, with the plurality of circles winding around the longitudinal axis to form an Archimedean spiral cross-section perpendicular to the longitudinal axis at continuously increasing radial distance from the longitudinal axis to form the transport channel, with the sleeve member mounted around the Archimedean spiral cross-section.

11. The metallic wick assembly as claimed in claim 1, further comprising a cap mounted on an open end of the fuel tank and including a bottom portion, with the through hole longitudinally extending through the bottom portion, with an annular abutted portion formed around the through hole and extending from the bottom portion towards but spaced from the bottom of the fuel tank, with the sleeve member received in the through hole and the annular abutted portion.

12. The metallic wick assembly as claimed in claim 11, wherein the at least one member comprises a plurality of mesh members with each including a corresponding sleeve member mounted therearound.

13. The metallic wick assembly as claimed in claim 1, wherein the sleeve member has a plurality of apertures located intermediate the bottom and the through hole of the fuel tank.

14. The metallic wick assembly as claimed in claim 1, wherein the at least one mesh member includes a plurality of mesh members respectively rolled into the plurality of different-sized tubes assembled and radially spaced from each other along a longitudinal axis to form a concentric circular cross section perpendicular to the longitudinal axis, with the sleeve member mounted around the plurality of different sized tubes.

15. The metallic wick assembly as claimed in claim 1, wherein the at least one mesh member includes a plurality of mesh members spaced from each other and arranged in a longitudinal stacked array, with the sleeve member mounted around the longitudinal stacked array.

16. The metallic wick assembly as claimed in claim 15, wherein each of the plurality of mesh members is formed in a flat shape.

17. A metallic wick assembly comprising:

at least one mesh member including first and second ends disposed opposite to each other, first and second surfaces respectively extended from the first end to the second end thereof and arranged opposite to each other, a plurality of meshes penetrating the first and second surfaces between the first and second ends thereof, and a transport channel extending from the first end to the second end thereof, with the mesh member including a first length defined between the first and second ends thereof;

a sleeve member mounted around each at least one mesh member and including a second length defined between a distal end and an longitudinal opposite end thereof, with the second length being less than the first length;

wherein a third length is defined between the distal end of the sleeve member and the first end of the at least one mesh member, with the sleeve member slidable with respect to the mesh member to adjust the third length; and a fuel tank having a through hole and a bottom, with the sleeve member received in the through hole, with the longitudinal opposite end located in the fuel tank, with the second end of the at least one mesh member located in the fuel tank, wherein the sleeve member has a plurality of apertures located intermediate the bottom and the through hole of the fuel tank, with the first end of the at least one mesh member and the distal end of the sleeve member located outward of the fuel tank, with the transport channel drawing fuel from the fuel tank by capillary action inside the sleeve member, with the third length being adjusted for controlling a flame scale.

18. The metallic wick assembly as claimed in claim 17, wherein the at least one mesh member is rolled into a tubular shape and having a plurality of circles spaced from each other along a longitudinal axis, with the plurality of circles winding around the longitudinal axis to form an Archimedean spiral cross-section perpendicular to the longitudinal axis at continuously increasing radial distance from the longitudinal axis to form the transport channel, with the sleeve member mounted around the Archimedean spiral cross-section.

19. The metallic wick assembly as claimed in claim 18, wherein the transport channel includes a central section disposed adjacent to the longitudinal axis and an annular section connected with and winding around the central section.

20. The metallic wick assembly as claimed in claim 17, further comprising a cap mounted on an open end of the fuel tank and including a bottom portion, with the through hole longitudinally extending through the bottom portion, with an annular abutted portion formed around the through hole and extending from the bottom portion towards but spaced from the bottom of the fuel tank, with the sleeve member received in the through hole and the annular abutted portion.

* * * * *